US011842594B2

(12) United States Patent
Tan et al.

(10) Patent No.: US 11,842,594 B2
(45) Date of Patent: Dec. 12, 2023

(54) CHIP PROCESSING SELF-SERVICE KIOSK

(71) Applicant: GENTING INTERNATIONAL GAMING & RESORT TECHNOLOGIES PTE. LTD, Singapore (SG)

(72) Inventors: Hee Teck Tan, Singapore (SG); Joon Fong Keith Goh, Singapore (SG); Li-Ling Sharon Yeo, Singapore (SG)

(73) Assignee: RESORTS WORLD AT SENTOSA PTE.LTD., Singapore (SG)

( * ) Notice: Subject to any disclaimer, the term of this patent is extended or adjusted under 35 U.S.C. 154(b) by 429 days.

(21) Appl. No.: 17/281,348

(22) PCT Filed: Sep. 17, 2019

(86) PCT No.: PCT/SG2019/050465

§ 371 (c)(1),
(2) Date: Mar. 30, 2021

(87) PCT Pub. No.: WO2020/072000

PCT Pub. Date: Apr. 9, 2020

(65) Prior Publication Data

US 2022/0122401 A1 Apr. 21, 2022

(30) Foreign Application Priority Data

Oct. 2, 2018 (SG) ..... 10201808711X

(51) Int. Cl.
*G07D 9/06* (2006.01)
*G07F 17/32* (2006.01)
(Continued)

(52) U.S. Cl.
CPC ..... *G07D 9/06* (2013.01); *G07D 5/02* (2013.01); *G07D 5/04* (2013.01); *G07D 9/002* (2013.01); *G07F 17/3248* (2013.01)

(58) Field of Classification Search
CPC ..... G07F 17/32; G07F 17/3248; G07F 17/42; G07F 19/20; G07F 19/202; G07F 19/203;
(Continued)

(56) References Cited

U.S. PATENT DOCUMENTS 4,088,144 A * 5/1978 Zimmermann ..... G07D 3/16 453/32
6,637,576 B1 * 10/2003 Jones ..... G07F 19/20 194/216

(Continued)

FOREIGN PATENT DOCUMENTS

AU 2005284875 A1 * 3/2007 ..... G07F 17/32
AU 2014200943 A1 * 9/2014

(Continued)

OTHER PUBLICATIONS

Patent Cooperation Treaty; PCT/SG2019/050465, International Search Report and Written Opinion.

(Continued)

*Primary Examiner* — Milap Shah
(74) *Attorney, Agent, or Firm* — Morgan, Lewis & Bockius LLP

(57) ABSTRACT

According to a first aspect of the present invention, there is provided a chip processing self-service kiosk comprising: a chip slot; a chip sensor; and a mechanical arrangement disposed downstream of the chip slot, the mechanical arrangement configured to allow received chips from the chip slot to be stacked in an orientation where the received chips are countable by the chip sensor.

21 Claims, 20 Drawing Sheets

(51) Int. Cl.
*G07D 5/02* (2006.01)
*G07D 5/04* (2006.01)
*G07D 9/00* (2006.01)

(58) Field of Classification Search
CPC ..... G07D 9/00; G07D 9/002; G07D 9/008; G07D 9/06; G07D 3/02; G07D 3/16; G07D 5/02; G07D 5/04
See application file for complete search history.

(56) References Cited

U.S. PATENT DOCUMENTS

| | | | | |
|---|---|---|---|---|
| 2003/0019716 | A1* | 1/2003 | Sugai | G07D 3/06 453/56 |
| 2005/0026683 | A1 | 2/2005 | Fujimoto | |
| 2007/0060313 | A1 | 3/2007 | Mathis et al. | |
| 2007/0099553 | A1* | 5/2007 | Blaha | G07D 3/14 209/552 |
| 2010/0029188 | A1* | 2/2010 | Komoto | G07D 1/02 453/18 |
| 2010/0160032 | A1 | 6/2010 | Paton | |
| 2013/0062156 | A1 | 3/2013 | Chandaria | |
| 2013/0298679 | A1 | 11/2013 | Snider et al. | |
| 2014/0332341 | A1 | 11/2014 | Crist et al. | |
| 2017/0011374 | A1* | 1/2017 | McDivitt | G07F 17/3248 |
| 2017/0294066 | A1* | 10/2017 | Krenn | G07D 3/06 |

FOREIGN PATENT DOCUMENTS

| | | | |
|---|---|---|---|
| BR | 8606929 | A * | 11/1987 |
| CA | 2617257 | A1 * | 2/2007 |
| CN | 201482141 | | 5/2010 |
| CN | 103971442 | A * | 8/2014 |
| CN | 204856629 | | 12/2015 |
| CN | 106296980 | | 1/2017 |
| CN | 107848640 | | 3/2018 |
| CN | 107930100 | | 4/2018 |
| CN | 104303213 | | 11/2018 |
| EP | 1927955 | A1 * | 6/2008 |
| EP | 2131333 | A1 * | 12/2009 |
| EP | 2230645 | | 9/2010 |
| EP | 2230645 | A1 * | 9/2010 |
| GB | 1505084 | | 3/1978 |
| JP | 2002216215 | | 8/2002 |
| JP | 2007330626 | | 12/2007 |
| JP | 4474563 | B2 * | 6/2010 |
| JP | 2018512682 | | 5/2018 |
| KR | 0072280 | | 10/2009 |
| KR | 0987953 | | 10/2010 |
| WO | 0167185 | | 9/2001 |
| WO | 2001067185 | | 9/2001 |

OTHER PUBLICATIONS

Intellectual Property Office of Singapore, 2018/48274811883W, dated Nov. 1, 2018, Search Report and Written Opinion.
Intellectual Property Office of Singapore, 2019/57753401472T, dated Aug. 2, 070189, Written Opinion.
Intellectual Property Office of Singapore, 2020/7145671881P, dated Jul. 13, 2020, Notice of Eligibility for Grant.
Japanese Office Action; F75023a1; Mailing No. 195048; dated Apr. 24, 2023; Appn: 2020-529673.
Chinese Office Action and Search Report; 100098; 010-56571319; dated Feb. 28, 2023.

* cited by examiner

CHIP PROCESSING SELF-SERVICE KIOSK

FIELD

The present invention relates to a self-service kiosk with chip processing capability that has application for casino usage.

BACKGROUND

Tokens are used in casinos, in lieu of cash, for several reasons. Because of their uniform size, shape, and patterns of stacks of chips, they are easier to tally compared to currency. This attribute enables quick verification of the amount being paid, reducing the chance that a dealer might incorrectly pay a customer. However, cashing out casino tokens can be labour intensive, where manpower used at a customer service counter may be put to better use.

Automated coin counting machines, such as vending machines, which count inserted coins and tabulate their total value do so through use of mechanical arrangements that rely on coins of different denominations having different sizes. As casino tokens have uniform size and shape, the approach used in such automated coin counting machines do not assist with automating the process of encashing casino tokens. Neither do self-service machines used in casinos that are for processing membership stored reward cards.

An object of the present invention is to provide a self-service kiosk that addresses the shortcomings of the outlined existing systems.

SUMMARY OF THE INVENTION

According to a first aspect of the present invention, there is provided a chip processing self-service kiosk comprising: a chip slot; a chip sensor; and a mechanical arrangement disposed downstream of the chip slot, the mechanical arrangement configured to allow received chips from the chip slot to be stacked in an orientation where the received chips are countable by the chip sensor.

BRIEF DESCRIPTION OF THE DRAWINGS

Representative embodiments of the present invention are herein described, by way of example only, with reference to the accompanying drawings, wherein.

DETAILED DESCRIPTION

Figure 1:
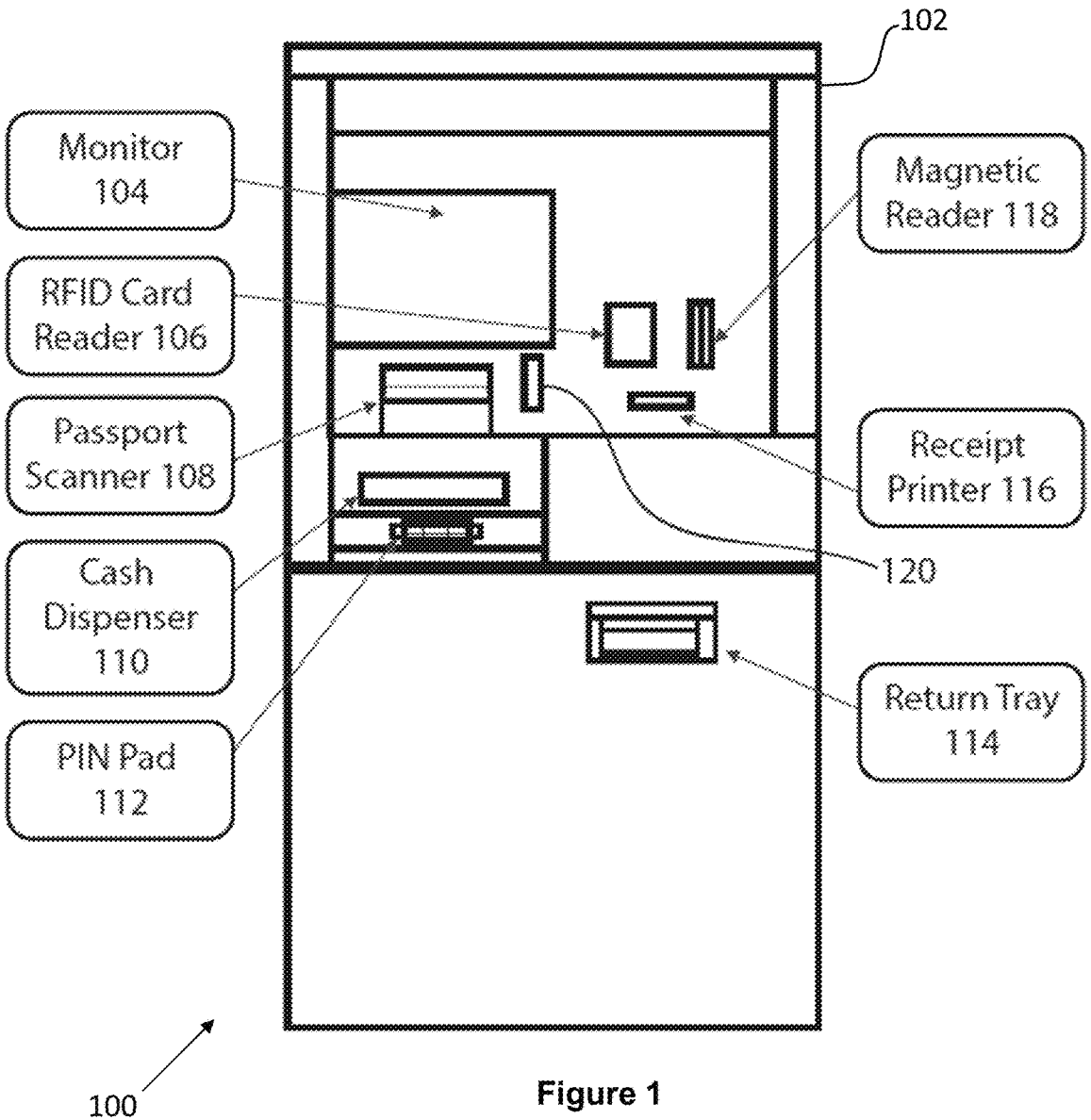
FIG. 1 is a front view of a top door of a self-service kiosk having a chip processing function in accordance with one embodiment of the present invention.

In the following description, various embodiments are described with reference to the drawings, where like reference characters generally refer to the same parts throughout the different views.

The present application, in a broad overview, relates to a self-service kiosk that is able to detect when chips are received and authenticates them by determining whether they are recognised, i.e. belong to a particular party, being generally the same party that operates the self-service kiosk. Once the received chips are authenticated, they are counted. Confirmation may be sought on the counted number of received chips before the chips are deposited. In an implementation where the chips are casino tokens and have monetary value, the self-service kiosk tabulates the total monetary value of the received tokens. Confirmation may also be sought on the calculated monetary value before cash amounting to the calculated monetary value is dispensed.

Casino tokens generally have the same size and shape. However, it is possible that token size depends on its denomination; or only a special category of casino tokens have a different size, while all other denominations have the same size. In addition, while a common shape used for casino tokens is circular, other shapes, such as: oval, ellipsoid and polygon (triangle, square, rectangle, etc) may be used.

The self-service kiosk may return the received tokens should it experience any one or more situations that are not limited to: a) one or more of the received tokens failing authentication for being unrecognisable; b) receiving user indication that the counted number of tokens is incorrect; c) receiving user indication that the calculated monetary value of the counted number of tokens is incorrect; and d) a discrepancy between a measured weight of the received tokens and their weight as derived from the counted number of the received tokens (explained in further detail below).

FIG. 1 is a front view 102 of a top door 102 of a self-service kiosk 100 having a chip processing function in accordance with one embodiment of the present invention. In this disclosure, "kiosk" refers to a machine configured with automated capabilities in relation to chip processing services, the services being not limited to: receiving these chips, counting them and confirming their authenticity; determining an identity of a user of the kiosk; seeking user confirmation of the counted chips; tabulating, when applicable, a monetary value for the counted chips; dispensing the monetary value upon receipt of user confirmation; storing the correctly counted chips; returning rejected chips which are either those received chips that fail authentication, or all the received chips if one or more of them fail authentication; and printing of a receipt of use having details such as the number of received chips and a dispensed money amount. The automated capabilities refer to a programmed sequence of steps that when executed causes all services provided by the self-service kiosk 100 to operate independently, such as prompting for user input at certain points (e.g. confirmation of chip count) and reacting when the user input is received. The term "self-service" refers to the kiosk having input interfaces (such as a keypad) for allowing a user to interact with the self-service kiosk 100.

The top door 102 has a monitor 104, a RFID (radio frequency identification) reader 106, a passport scanner 108, a cash dispenser 110, a keypad 112, a return tray 114, a receipt printer 116, a magnetic strip reader 118 and a chip slot 120.

The monitor 104 allows display of the status of the self-service kiosk 100, such as whether the self-service kiosk 100 is under maintenance or whether it is in a standby state ready to receive chips. The monitor 104 also displays instructions on use of the self-service kiosk 100, which may begin with an indication of the type of chips the self-service kiosk 100 is designed to process, so that a user will be made aware that other types of chips are unrecognisable. In the implementation where the self-service kiosk 100 is used to process casino tokens, these would be casino tokens belonging to a casino organisation in which the self-service kiosk 100 is operated, whereby casino tokens belonging to another casino organisation would not be recognised by the self-service kiosk 100. The monitor 104 may also display information pertaining to each stage of chip processing, such as from the start where the user is directed to insert chips into the chip slot 120, to the end where the user is directed to: either collect the monetary value of the chips from the cash dispenser 110 if they are successfully counted or collect the chips from the return tray 114 if they are unsuccessfully counted. The monitor 104 is also used to request input from the user to complete the counting process and to ask the user to wait while the received chips are being counted. If the monitor 104 has touch screen capability, it can be used to receive user input during chip processing.

Each of the RFID reader 106, the passport scanner 108 and the magnetic strip reader 118 allows the self-service kiosk 100 to identify its user. The RFID reader 106 may be configured to read identification details that are stored in mediums embedded with an RFID chip, such as a contactless card. The magnetic strip reader 118 is to read identification details stored on non-contactless mediums, such as a card with a magnetic strip. The passport scanner 108 may be an optical reader or a biometric sensor that is able to read identification details from the data page of a passport.

The cash dispenser 110 is an outlet of the self-service kiosk 100 through which money is dispensed. The cash dispenser 110 is activated when chips inserted in the chip slot 120 are successfully authenticated and counted, whereby the dispensed amount is the monetary value of the counted received chips.

The keypad 112 allows for a user to provide input into the self-service kiosk 100, required during a chip processing operation performed by the self-service kiosk 100. In an implementation where the monitor 104 has touch screen capability, the keypad 112 may provide an additional input mechanism to the self-service kiosk 100. Alternatively, the self-service kiosk 100 may be configured such that input for selected stages of the chip processing operation is obtained from the monitor 104 while input for the remaining stages is obtained from the keypad 112. The keypad 112 may be any one or more of a keyboard with buttons or a virtual keyboard, if the keypad is a touch sensitive screen.

The return tray 114 is an outlet of the self-service kiosk 100 allowing for received chips from the chip counting operation to be returned to the user. Such return occurs from user selection, for instance when the user disagrees with the number of chips that are counted by the self-service kiosk 100. Alternatively, return of the received chips may occur in a rejection scenario, where the self-service kiosk 100 is configured to return only the received chips that fail authentication or all of the received chips if one or more of them fail authentication.

The receipt printer 116 provides a receipt of use of the self-service kiosk 100. In one approach, a receipt documenting the usage of the self-service kiosk 100 may be printed whether chips are inserted into the chip slot 120 regardless of whether the self-service kiosk 100 eventually dispenses money. The receipt may provide details of the chip processing operation, such as whether the inserted chips are successfully authenticated, the counted number of chips and the calculated value of the counted chips. In another approach, a receipt is only printed when the self-service kiosk 100 successfully authenticates received chips and dispenses a monetary value for the counted chips, whereby the receipt provides details on the number of counted chips and the dispensed monetary amount.

The chip slot 120 is an inlet of the self-service kiosk 100 through which chips are inserted. In one implementation, the chip slot has an opening width that is the thickness of a single received chip, to prevent multiple chips from being inserted each time. Restricting insertion to a chip at a time facilitates sensing of the number of chips received by the self-service kiosk 100, which assists in ensuring that the number of received chips does not exceed a quota which the self-service kiosk 100 is configured to process in one pass, i.e. in a single counting operation. When the quota is reached, a shutter mechanism (not shown) is configured to close the chip slot 120 when the received chips reaches a quota countable by a chip sensor 204 (see FIG. 2) in one pass. This shutter mechanism may be located adjacent to the chip slot 120.

Figure 2:
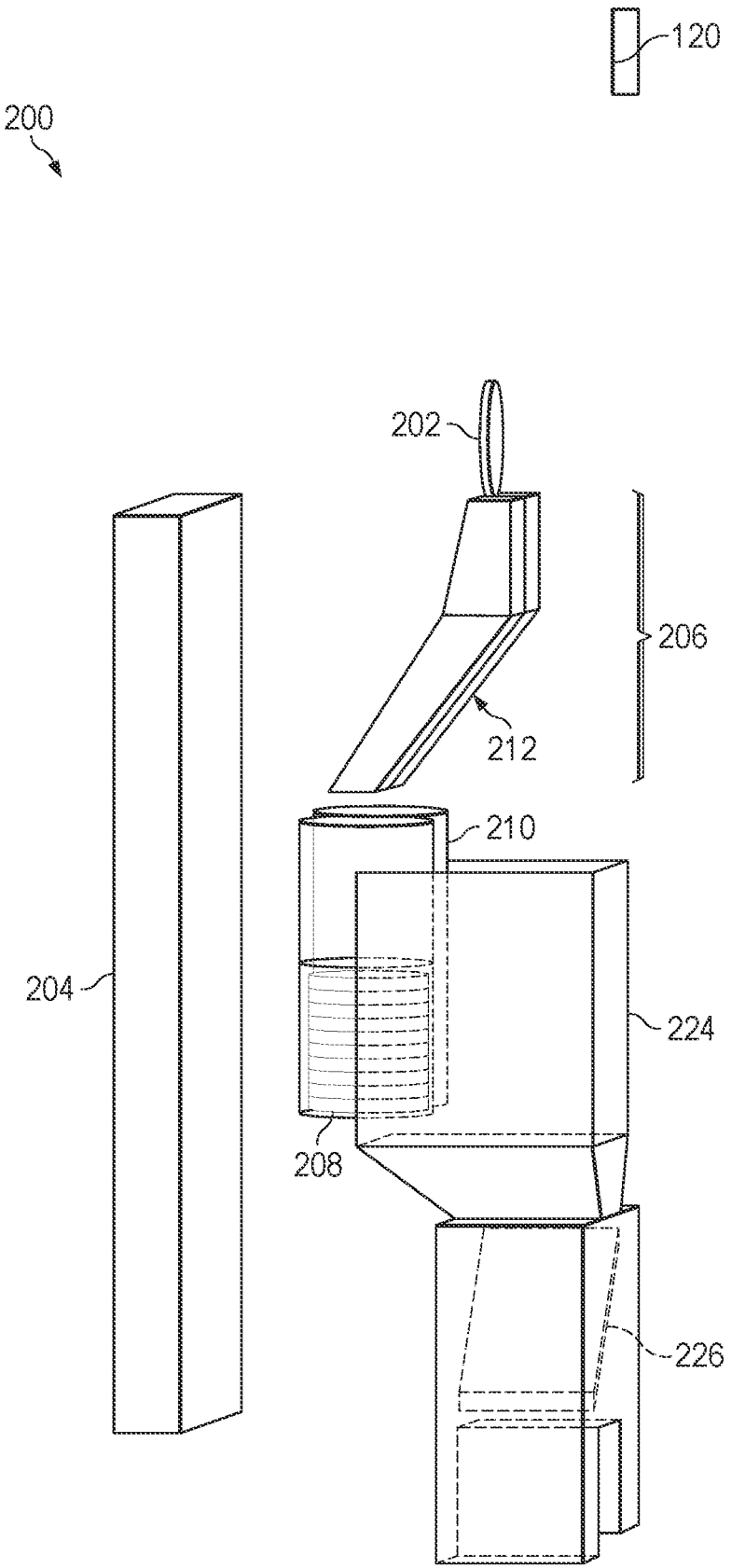
FIG. 2 is a perspective view of a first implementation of a detection stage of the self-service kiosk of FIG. 1.

FIG. 2 is a perspective view of a detection stage 200 of the self-service kiosk 100 of FIG. 1. The detection stage 200 is located inside the housing of the self-service kiosk 100 and downstream from the chip slot 120, which for the sake of simplicity is symbolically shown in FIG. 2.

The detection stage 200 is where the chips 202 received from the chip slot 120 are allowed to stack 208 and be displaced, if required, for them to be read by a detector for the purposes of authentication and to be counted. The detection stage 200 thus includes a chip sensor 204 to serve as the detector and a mechanical arrangement 206 for facilitating the displacement. The detection stage 200 also has a chute 224 with a divider 226, both of which are described in further detail with respect to FIG. 10.

The chip sensor 204 refers to a detector that is able to read an electronic tag (e.g. an embedded RFID electronic chip) that is present in each of the received chips 202. In one implementation, the chip sensor 204 may be a radio wave transceiver. In another implementation, the chip sensor 204 may be a RFID directional antenna. Such a RFID directional antenna is used, especially those with focused beam width, when the self-service kiosk 100 is used for casino tokens because they can more accurately detect and count casino tokens.

After the chips 202 pass through the chip slot 120, they experience a free fall. An uncontrolled free fall into a holding area may have the received chips 202 collect in a pile where each of their electronic tags may not be captured by the chip sensor 204. The mechanical arrangement 206 thus serves to circumvent such a free fall, thereby ensuring that each electronic tag in all received chips 202 are detected by the type of chip sensor 204 used (especially those of beam width focused configuration), by orientating the received chips 202 to be readable by the chip sensor 204.

The mechanical arrangement 206 refers to one or more structures that are appropriately arranged, with respect to each other, to allow the received chips 202 from the chip slot 120 to be stacked in an orientation where the received chips 202 are countable by the chip sensor 204. One or more of these structures are configured to actuate. In the implementation of FIG. 2, these one or more structures actuate to this orientation after the chips 202 are received.

The orientation where the received chips 202 are readable by the chip sensor 204 refers to the received chips 202 being placed in one or more of an angle, position or alignment to the chip sensor 204, where all can be read by the chip sensor 204. The stacking of the received chips 202 facilitated by the one or more structures of the mechanical arrangement 206 refers to allowing the received chips 202 to accumulate through, for example, letting them increase in layers by dropping them one on top of the other.

As mentioned above, the mechanical arrangement 206 has at least one structure that actuates the received chips 202 into an orientation where they are countable by the chip sensor 204, after the chips 202 are received. The actuatable structures of the mechanical arrangement 206 include a receptacle 210 for the received chips 202 from the chip input 120 and an actuator (not shown) that is coupled to actuate the receptacle 210.

The receptacle 210 is in an upright position when at rest, as shown in FIG. 2. Having the receptacle 210 located in an upright position at rest is advantageous to seek having the received chips 202 land flat inside the receptacle 210. To increase the likelihood of the received chips 202 landing flat and forming the stack 208, the implementation shown in FIG. 2 has one or more openings of the receptacle 210 dimensioned to have a cross section that matches the perimeter of the chip 202. This causes each opening dimension to be not wide enough to accommodate having two chips 202 lying side by side. However, the receptacle 210 is still able to have more than one chip 202 per layer which occurs when each stack 208 of received chips 202 is held in separate openings. In the implementation of FIG. 2, the receptacle 210 has two openings, where the second opening is more clearly seen in FIG. 3.

The mechanical arrangement 206 further includes a passageway 212 disposed to guide the received chips 202 from the chip slot 120 into the receptacle 210. This passageway 212 serves to ensure that the received chips 202 end up stacking in the receptacle 210, especially when the receptacle 210 is located a distance from the chip slot 120. The entrance of the passageway 212 is located adjacent to the chip slot 120, while its exit is located adjacent to the receptacle 210 opening. For the sake of simplicity, only the portion of the passageway 212 that is adjacent to the receptacle 210 is shown, while the remainder is omitted. The passageway 212 is an immovable structure, in contrast to the receptacle 210 and the actuator to which the receptacle 210 is coupled.

In the upright position, the stack 208 of received chips 202 is misaligned relative to the chip sensor 204 in that the chip sensor 204 is not able to detect all of the received chips 202. Thus, after all the chips 202 are received, the actuator is configured to tilt the receptacle 210 to an orientation where the chip sensor 204 can read the stack 208 of received chips 202 to either count them, authenticate them, or both. The tilting performed by the actuator is shown in FIG. 3.

Figure 3:
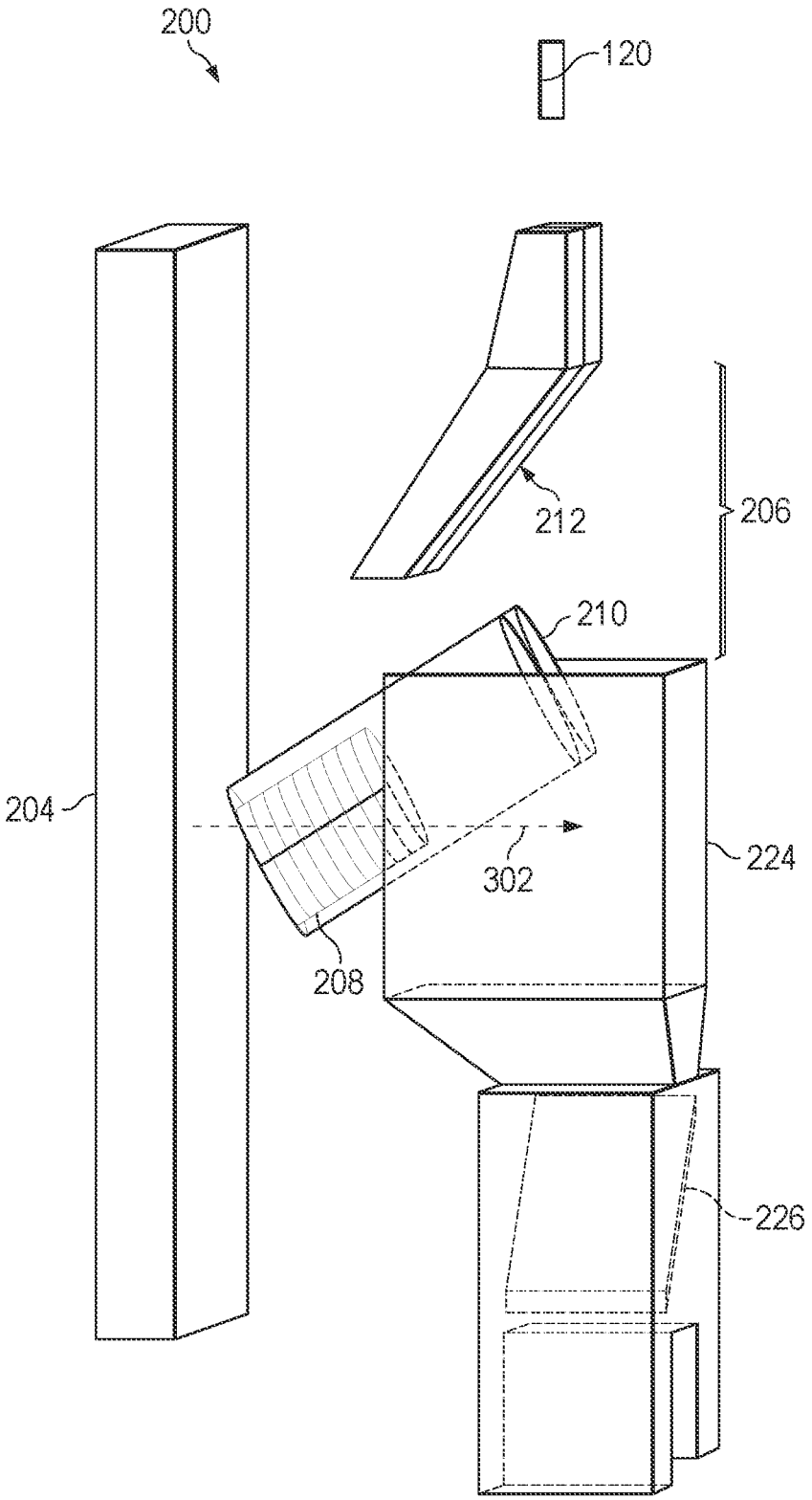
FIG. 3 shows a receptacle of the detection stage of FIG. 2 tilting for received chips to be read.

As shown in FIG. 3, the receptacle 210 is no longer in an upright position, but tilted such that all of the stack 208 of received chips 202 are aligned to a detection beam 302 that is emitted by the chip sensor 204 to read data coded into an electronic tag present in each of the received chips 202. The angle of tilt depends on several factors, such as the location of the electronic tag in each of the received chips 202 and the type of detector used for the chip sensor 204, but is within 0° to 90°, i.e. before the receptacle 210 is at a perpendicular angle to the chip sensor 204 so as to prevent the received chips 202 from falling out before they can be counted, authenticated, or both. Further, the chip sensor 204 and the receptacle 210 are disposed in an electromagnetic shielding enclosure, which is not shown in FIG. 2, so that the components of the chip sensor 204, the receptacle 210 and the chute 224 can be clearly seen. The electromagnetic shielding enclosure prevents external electromagnetic signals (such as those generated when a user operates his mobile phone while using the self-service kiosk 100) from interfering with the chip sensor 204 operation. Accordingly, the detection stage 200 provides a mechanism that is able to automate the detection of chips in a reliable manner.

Figure 4:
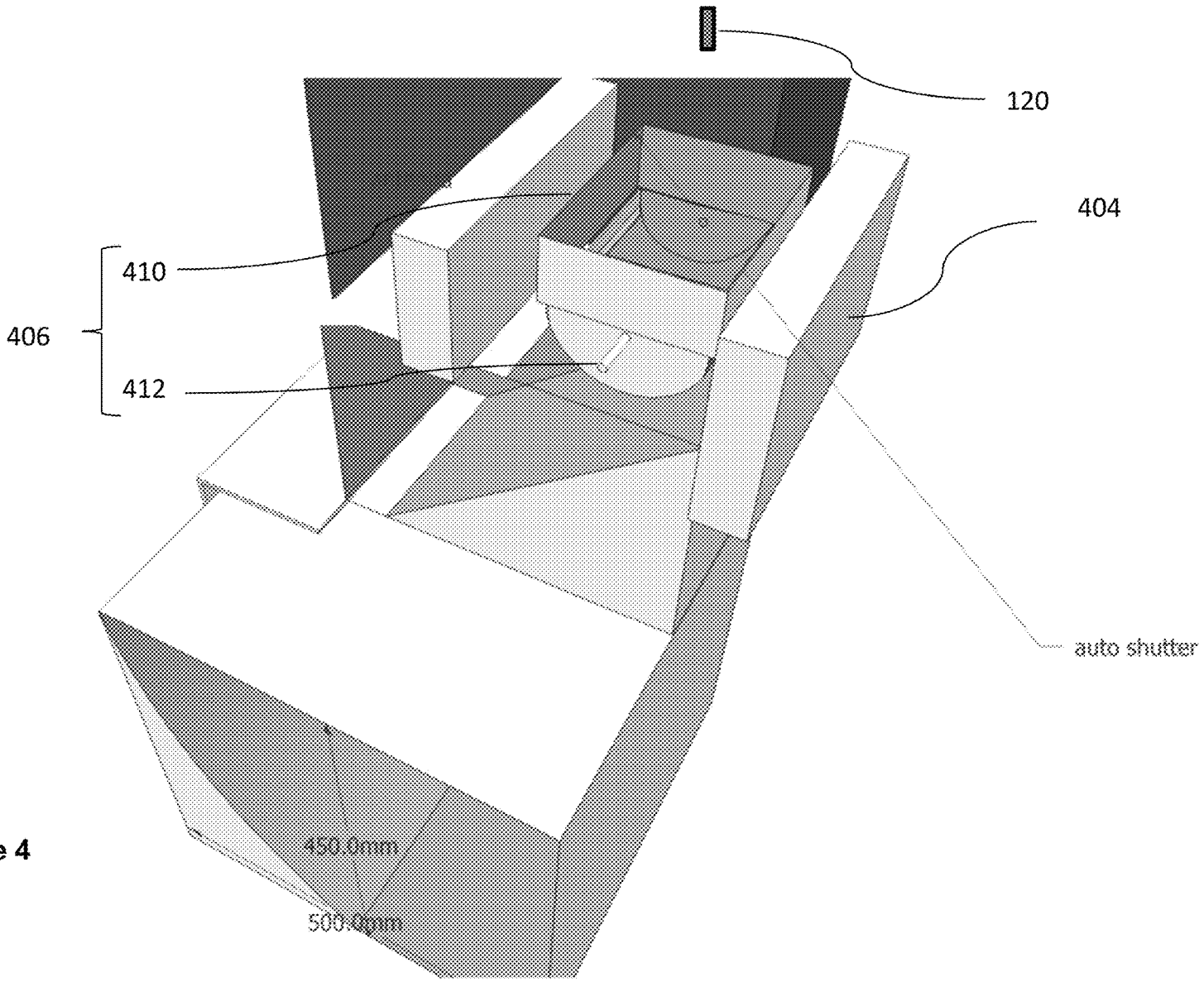
FIG. 4 is a perspective view of a second implementation of a detection stage of the self-service kiosk of FIG. 1.

FIG. 4 is a perspective view of a detection stage 400 of the self-service kiosk 100 of FIG. 1.

Similar to the detection stage 200 of FIGS. 2 and 3, the detection stage 400 of FIG. 4 is where chips (not shown) are received from the chip slot 120 (also confer FIG. 1) are allowed to stack and be displaced, if required, for them to be read by a detector for the purposes of authentication and to be counted. The detection stage 400 thus includes a chip sensor 404 to serve as the detector and a mechanical arrangement 406 for facilitating the displacement.

The chip sensor 404 functions identically to the chip sensor 204 of FIG. 2 and is thus not further elaborated. Similar to the mechanical arrangement 206 of FIG. 2, the mechanical arrangement 406 of FIG. 4 refers to one or more structures that are appropriately arranged, with respect to each other, to allow the received chips from the chip slot 120 to be stacked in an orientation where the received chips 202 are countable by the chip sensor 204. One or more of these structures are configured to actuate.

In contrast to the implementation of FIG. 2, the implementation of FIG. 4 has the one or more actuatable structures of the mechanical arrangement 406 already in this orientation when at rest, i.e. at the moment the chips are received from the chip slot 120.

The actuatable structures of the mechanical arrangement 406 include a receptacle 410 for the received chips from the chip input 120 and an actuator 412 that is coupled to actuate the receptacle 410. The orientation of the receptacle 410 when at rest is more clearly shown in FIG. 5.

Figure 5:
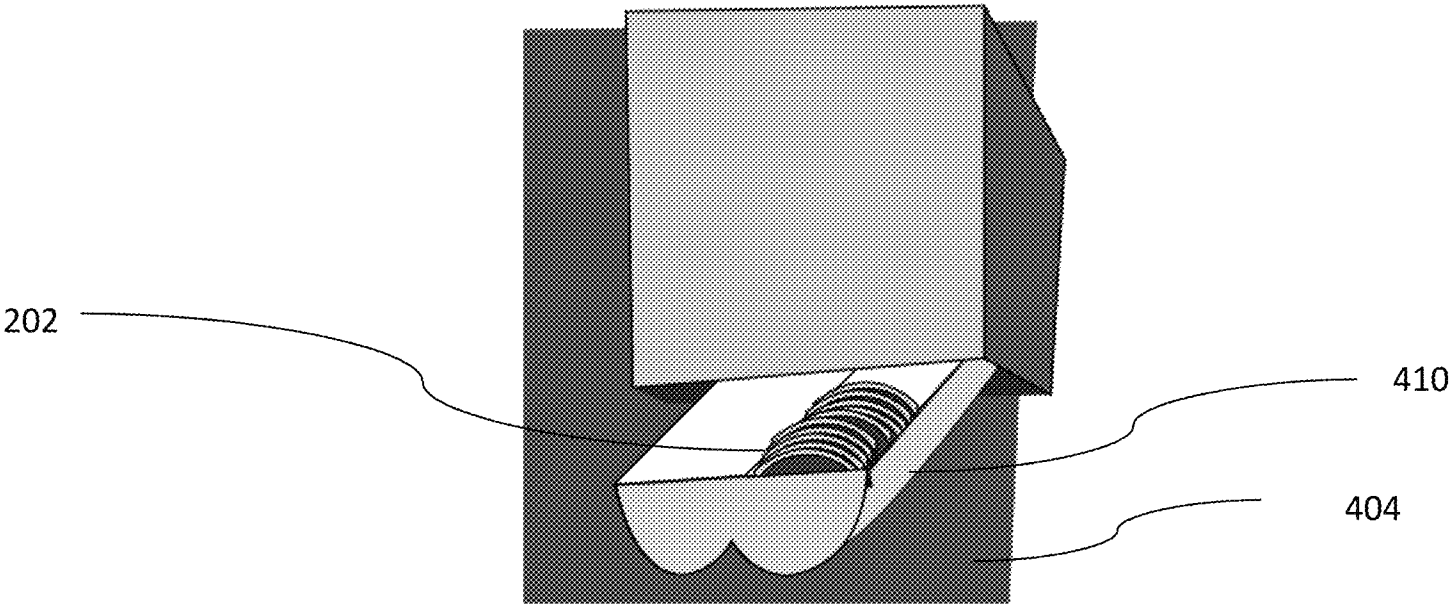
FIG. 5 shows a default orientation of a receptacle of the detection stage of FIG. 4.

As shown in FIG. 5, the receptacle 410 is, by default, tilted in the orientation where the received chips 202 are countable by the chip sensor 404. "Default" refers to the position that the receptacle 410 is in when receiving chips for counting and/or authentication, i.e. when the receptacle 410 is empty. The receptacle 410 is able to have such a tilted orientation because the receptacle 410 is located adjacent to the chip slot 120, so that the chip 202 falls into either of two rows of the receptacle 410 after being inserted into the chip slot, or the chip slot 120 is designed to open to allow the user to directly stack the chips 202 in either of these two rows. Accordingly, in contrast to the implementation of FIG. 2, the implementation of FIG. 4 does not require for a passageway to guide the received chips from the chip slot 120 into the receptacle 410.

FIGS. 2 and 3 show that the received chips 202 stack in the receptacle 210 in a generally vertical direction, i.e. at default, the received chips 202 collect in a stack that is parallel to the disposition of the chip sensor 204. FIGS. 4 and 5 show that the received chips 202 stack in the receptacle 410 in a generally horizontal direction, i.e. at default, the received chips 202 collect in a stack that is perpendicular to the disposition of the chip sensor 404. The commonality in the vertically stacked chips 202 in FIGS. 2 and 3 and the horizontally stacked chips 202 in FIGS. 4 and 5 is that they are arranged such that their respective peripheries align, i.e. adjacent chips 202 are in contact generally along the entire length of their respective perimeters. In the case of FIGS. 2 and 3, such alignment is facilitated by using chips 202 each having a dimension that matches the cross section of each opening in the receptacle 210, while in the case of FIGS. 4 and 5, such alignment is facilitated by using chips 202 each having a dimension that matches the width of each row in the receptacle 410.

While preferred, it is not essential that the stacked chips 202 be in peripheral alignment. The chips 202 are considered "stacked" when chips in adjacent layers are in contact, even when the perimeter of a chip 202 in one layer is misaligned with the perimeter of a chip 202 in an adjacent layer. Such misalignment may occur when the chip 202 dimension is smaller than the cross section of each opening in the receptacle 210 or cross section of each row in the receptacle 410; or when the chips 202 have different dimensions. The chip sensor 204 is still able to detect the received chips 202 when the receptacle 210, 410 is suitably orientated. Several of such stacking arrangements are shown in FIGS. 6A to 6C, where it will be appreciated that each arrangement is possible depending on how chips 202 fall into the receptacle 210, in the implementation of FIGS. 2 and 3; or if the chips 202 are loaded in a haphazard manner, in the implementation of FIGS. 4 and 5.

Figure 6A:
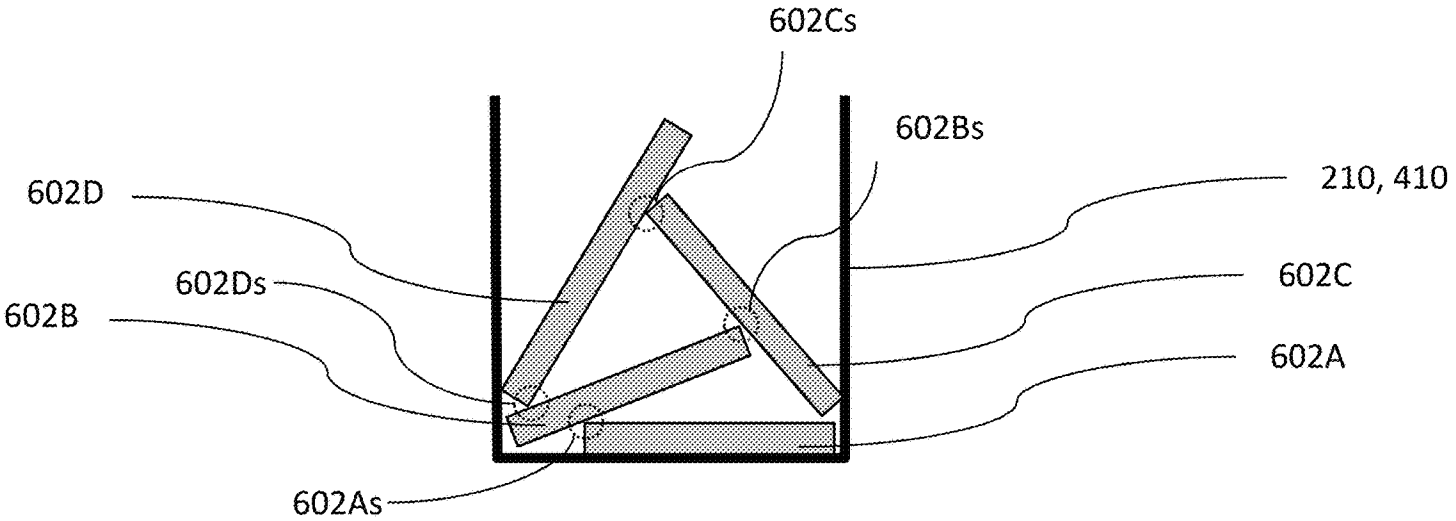
FIGS. 6A to 6C show various stacking configurations of chips received in the receptacle of the detection stage of FIGS. 2 and 4.
Figure 6B:
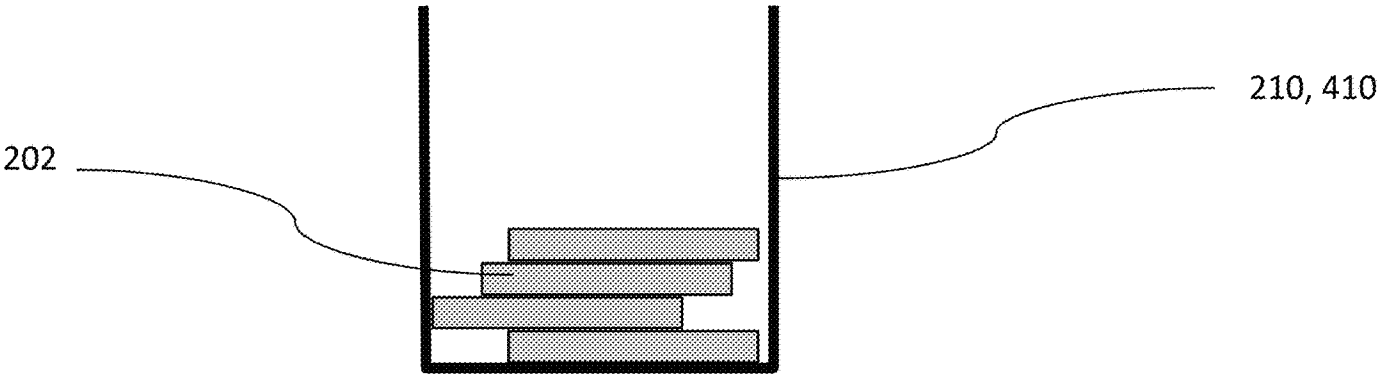
Figure 6C:
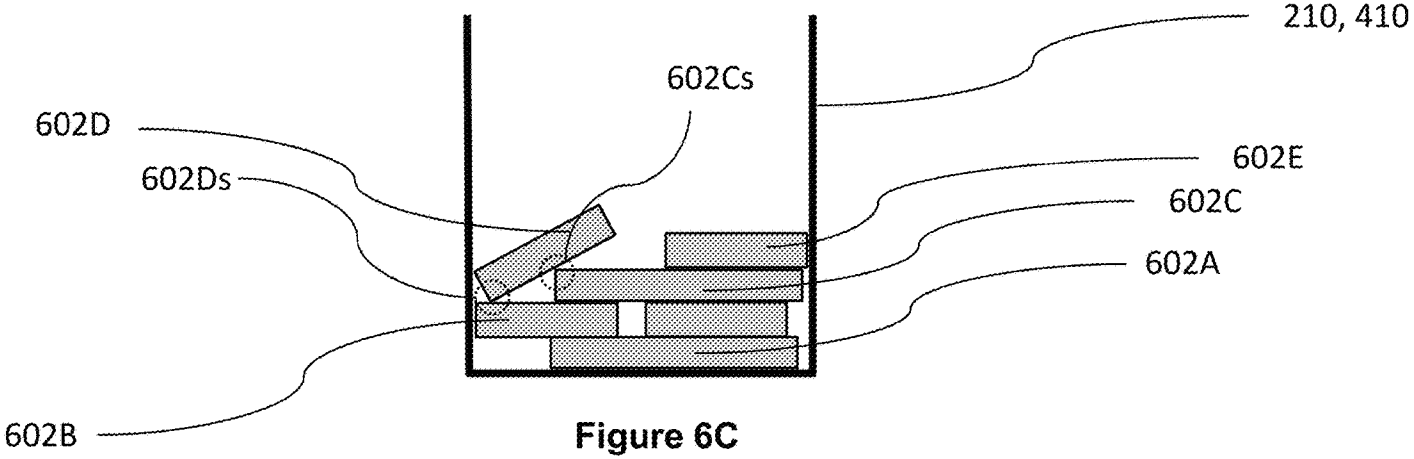

FIGS. 6A to 6C each show a portion of the receptacle 210, 410. In FIG. 6A, chips 602A and 602B have equal dimensions. Chip 602C has a larger dimension than the chips 602A and 602B and chip 602D has the largest dimension. The chips 602A, 602B, 602C and 602D do not stack in a parallel manner. While a denomination bearing surface of the chip 602A is entirely in contact with a wall of the receptacle 210, 410, contact between the chip 602B and the chip 602A is through the chip 602B resting against only a segment 602As of the perimeter of the chip 602A. As such, the perimeter of the chip 602B is misaligned with the perimeter of the chip 602A, with the chip 602B being in a second layer that is adjacent and above a first layer to which the chip 602A belongs. Such perimeter misalignment is also present between the chip 602B and the chip 602C, through the chip 602C resting against only a segment 602Bs of the perimeter of the chip 602B, with the chip 602C being in a third layer that is adjacent and above the second layer to which the chip 602A belongs. There is also slight contact between the chip 602D and the chip 602C through the chip 602D resting against only a segment 602Cs of the perimeter of the chip 602C. Although the chip 602D is also in contact with the chip 602B through the perimeter segment 602Ds, the chip 602D lies in a fourth layer that is adjacent to the third layer to which the chip 602C belongs.

In FIG. 6B, each of the chips 202 has equal dimension that is smaller than the cross section of each opening in the receptacle 210 or cross section of each row in the receptacle 410. Similar to FIG. 6A, there are four layers of chips 202. While the chips 202 stack in a parallel manner, each chip 202 is not positioned in the centre of the receptacle 210, 410, so that chips 202 in adjacent layers have their respective perimeters intersect, but do not align.

FIG. 6C shows an arrangement that is a combination of the arrangements of FIGS. 6B and 6C in that while some chips are in parallel, other chips are not. The chip 602A in the first layer, the chips 602B in the second layer and the chip 602C in the third layer are stacked in parallel. However, while one chip 602E in the fourth layer is parallel to the chips in the first to the third layers, the other chip 602D is not. A segment 602Ds of the perimeter of the chip 602D lies on the chip 602B from the second layer, while the chip 602D also lies on a segment 602Cs of the perimeter of the chip 602C in the third layer. FIG. 6C also shows that if the chips have small enough dimensions, two of them can belong to the same layer, such as the two chips 602B in the second layer and the two chips 602D and 602E in the fourth layer.

While the chip sensor 204 is capable of detecting and counting all the chips in any of the stacking arrangements shown in FIGS. 6A to 6C, after the stacked chips are orientated to be aligned with a detection beam of the chip sensor 204, it is still advantageous that the chips stack in parallel layers as shown in FIG. 6B before they are read by the chip sensor 204. This ensures a more accurate reading by the chip sensor 204 and allows for the receptacle 210, 410 to accommodate more chips to be read in one pass by the chip sensor 204. This is achieved by the receptacle 210, 410 being configured to shake before the received chips are read by the chip sensor 204.

Figure 6E:
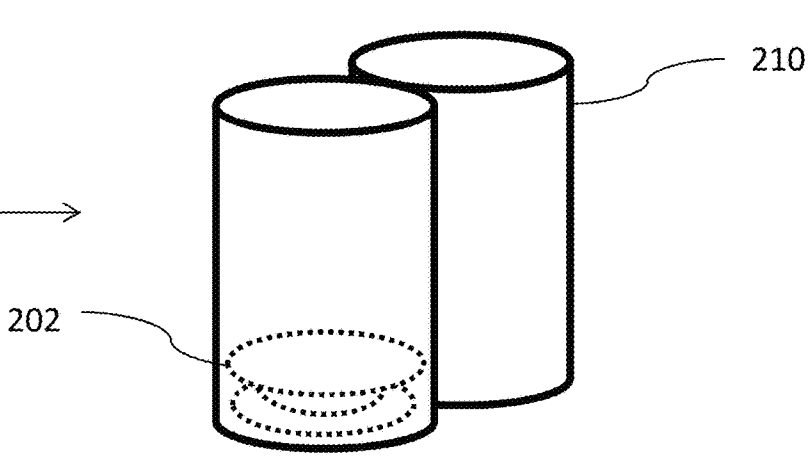
FIG. 6E shows dislodged chips.
Figure 6D:
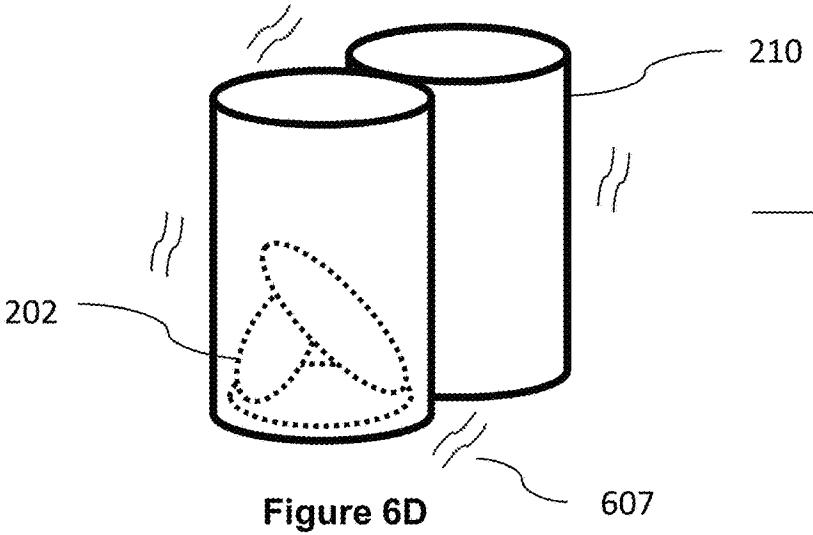
FIG. 6D shows the receptacle of FIGS. 2 and 3 being caused to shake to dislodge received chips to fall flat.

FIG. 6D shows the receptacle 210 of FIGS. 2 and 3 being caused to shake 607, with the mechanism responsible for shaking the receptacle 201 omitted for the sake of simplicity. In one implementation, this mechanism may be the actuator that is coupled to tilt the receptacle 210 to an orientation where the chip sensor 204 can read the stack 208 of received chips 202, as shown in FIG. 3. Alternatively, the mechanism may be realised through one or more actuators or a vibration motor coupled to the chip sensor 204 that are responsible for the shaking 607 of the receptacle 210. The shaking 607 dislodges the chips 202, so that they fall into parallel layers as shown in FIG. 6E, by virtue of their weight. Although not shown, the receptacle 410 of FIGS. 4 and 5 can also be configured to shake in a similar manner to that shown in FIGS. 6D and 6E.

Figure 7:
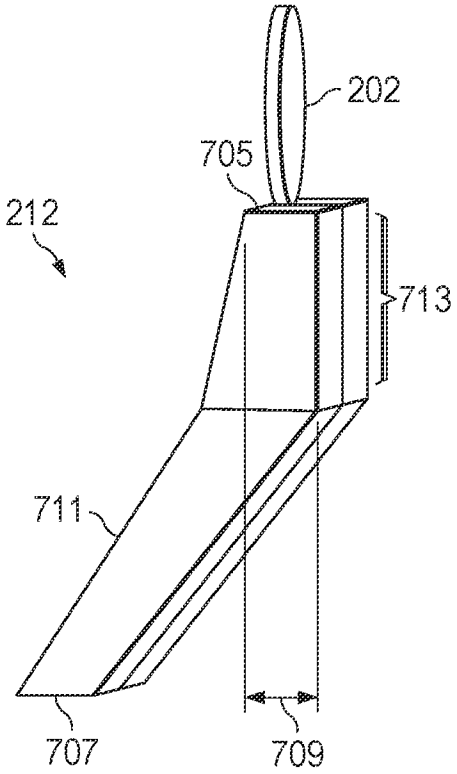
FIG. 7 shows perspective views of two passageways used to guide received chips from a chip slot into a receptacle for the received chips.
Figure 7:
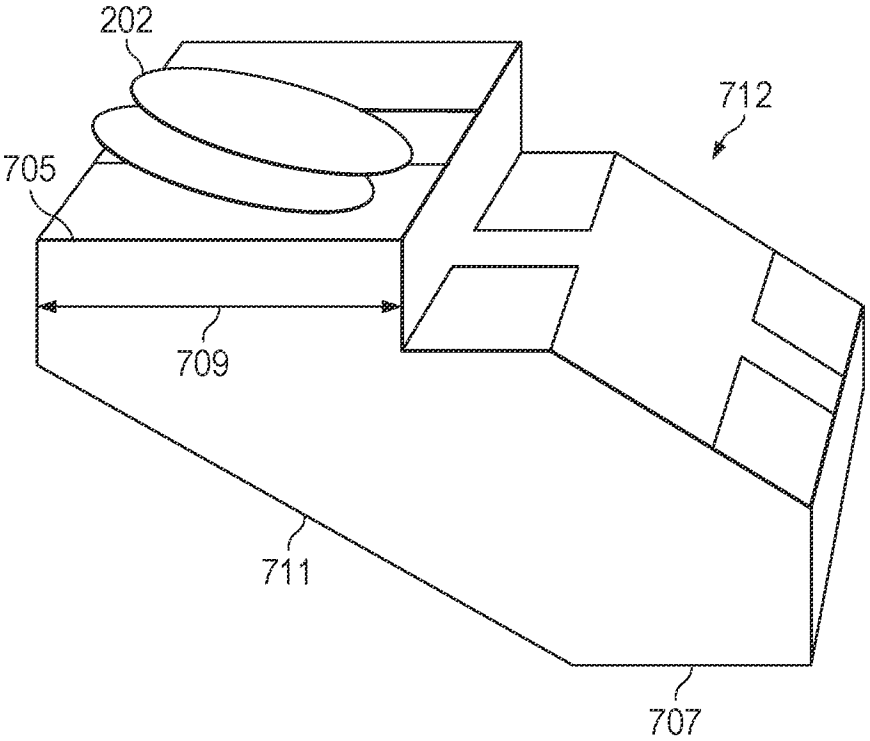

FIG. 7 shows perspective views of two passageways 712, 212 used to guide received chips from a chip slot 120 (see FIG. 1) into a receptacle for the received chips. The passageway 212 is replicated from that used in FIGS. 2 and 3. Each of the passageways 712, 212 has two channels, which when installed into the self-service kiosk 100, has their entrances 705 disposed adjacent to the chip slot 120 and their exits 707 disposed adjacent to the receptacle. The differences between the two passageways 712, 212 are discussed below.

Each channel entrance 705 of the passageway 712 has a width 709 that is larger than a width 709 of the channel entrance 705 of the passageway 212. This larger width 709 of the channel entrance 705 of the passageway 712 allows for the received chips 202 to enter the channel of the passageway 712 in a generally horizontal manner, while the received chips 202 enter the channel of the passageway 212 in a generally vertical manner. The larger width 709 of the passageway 712 channel entrance 705 allows for several chips to be received at one instance, while the number of chips that can be received by the passageway 212 channel entrance 705 is limited by its width 709. The passageway 712 has a constant slope 711 extending from its channel entrance 705 to its channel exit 707, while across its channel entrance 705 to its channel exit 707 the passageway 212 has a first portion 713 that is substantially vertical and a second portion that is sloped 711. It is found that the profile of the passageway 712 provides a higher likelihood of having the received chips 202 land flat in a receptacle located adjacent to the exit 707 as compared to the passageway 212. It was also found that manufacturing the passageways 712, 212 from acrylic increases the likelihood of the received chips 202 landing flat in the receptacle. In addition, the passageway 712 may have an internal constriction dimensioned to provide a gap to restrict the manner in which the chips 202 slide down the slope 711. When several chips 202 are simultaneously introduced into the channel entrance 705 of the passageway 712, the passage of the chips 202 along the slope 711 are slowed down by the internal constriction, so that the chips 202 are released from the channel exit 707 one at a time. This internal constriction further increases the likelihood of the received chips 202 landing flat in the receptacle.

Figure 8:
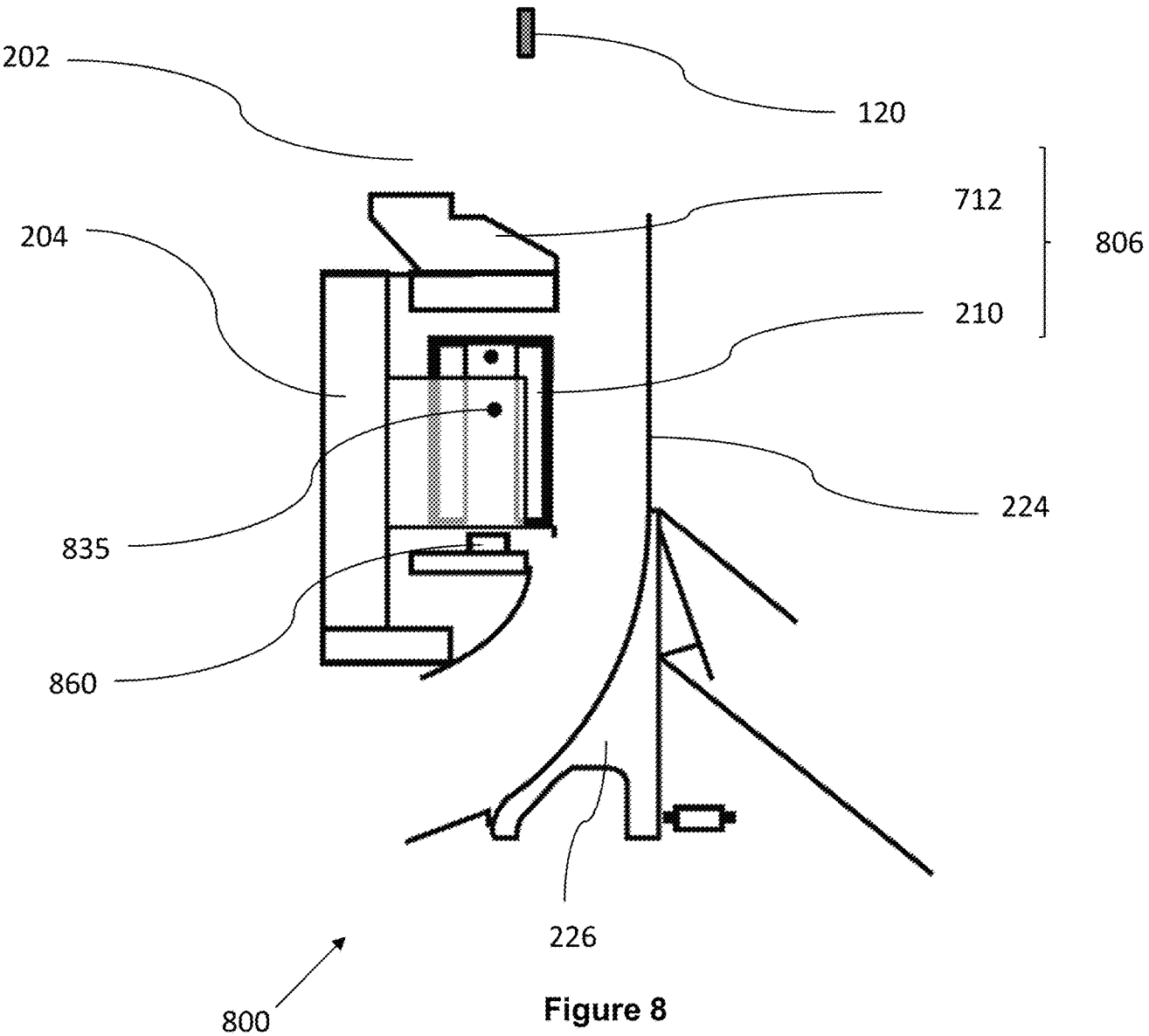
FIG. 8 is a side view of a third implementation of a detection stage of the self-service kiosk of FIG. 1.

FIG. 8 shows a side view of a detection stage 800 of the self-service kiosk 100 of FIG. 1 incorporating the passageway 712 of FIG. 7.

The detection stage 800 is located inside the housing of the self-service kiosk 100 and downstream from the chip slot 120, which for the sake of simplicity is symbolically shown in FIG. 2.

The detection stage 800 is where the chips 202 received from the chip slot 120 are allowed to stack inside the receptacle 210 and be displaced, if required, for them to be read the chip sensor 204 for the purposes of authentication and to be counted. The detection stage 800 includes a mechanical arrangement 806 for facilitating the displacement. The detection stage 800 also has a chute 224 with a divider 226, both of which function similarly to the chute 224 and the divider 226 of FIG. 2 respectively and are described in further detail with respect to FIG. 10. In addition, the detection stage 800 has a weight detector 826, which is described in further detail with respect to FIG. 13.

The chip sensor 204 and the receptacle 210 function identically to those shown in FIG. 2 and are thus not further elaborated. The main difference between the mechanical arrangement 806 used in FIG. 8 and the mechanical arrangement 206 of FIG. 2 is that the mechanical arrangement 806 uses the passageway 712 described in FIG. 7. The functionality of the mechanical arrangement 806 remains the same, to circumvent an uncontrolled free fall of the chips 202 into the receptacle 210, so that the received chips 202 are orientated to be readable by the chip sensor 204. The actuatable portion of the mechanical arrangement 806 which facilitates this orientation includes the receptacle 210 for the received chips 202 from the chip input 120 and an actuator 835 that is coupled to actuate the receptacle 210.

Similar to FIG. 2, the receptacle 210 is in an upright position when at rest, as shown in FIG. 8. Having the receptacle 210 located in an upright position at rest is advantageous to seek having the received chips 202 land flat inside the receptacle 210. To increase the likelihood of the received chips 202 landing flat and stacking, the implementation shown in FIG. 8 has one or more openings of the receptacle 210 dimensioned to have a cross section that matches the perimeter of the chip 202. This causes each opening dimension to be not wide enough to accommodate having two chips 202 lying side by side. However, the receptacle 210 is still able to have more than one chip 202 per layer which occurs when each stack 208 of received chips 202 is held in separate openings.

In the upright position, the stacked chips 202 in the receptacle 210 is misaligned relative to the chip sensor 204 in that the chip sensor 204 is not able to detect all of the received chips 202. Thus, after all the chips 202 are received, the actuator 835 is configured to tilt the receptacle 210 to an orientation where the chip sensor 204 can read the stacked chips 202 in the receptacle 210 to either count them, authenticate them, or both. The tilting performed by the actuator 835 is shown in FIG. 9.

Figure 9:
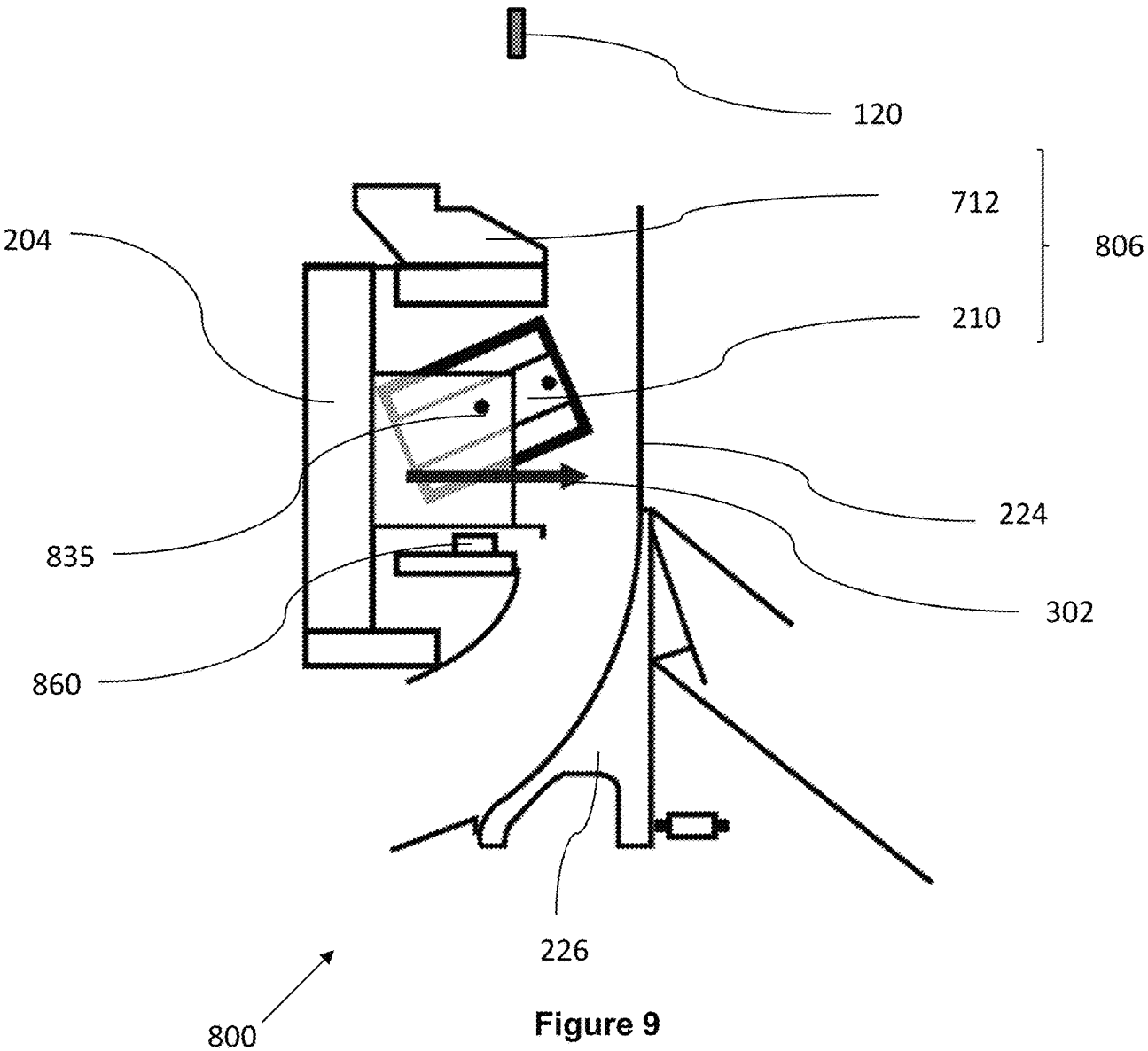
FIG. 9 shows a receptacle of the detection stage of FIG. 8 tilting for received chips to be read.

As shown in FIG. 9, the receptacle 210 is no longer in an upright position, but tilted such that all stacked chips 202 in the receptacle 210 are aligned to a detection beam 302 that is emitted by the chip sensor 204 to read data coded into an electronic tag present in each of the chips 202. The angle of tilt depends on several factors, such as the location of the electronic tag in each of the chips 202 and the type of detector used for the chip sensor 204, but is within 0° to 90°, i.e. before the receptacle 210 is at a perpendicular angle to the chip sensor 204 so as to prevent the received chips 202 from falling out before they can be counted, authenticated, or both. Similar to FIG. 2, the chip sensor 204 and the receptacle 210 are disposed in an electromagnetic shielding enclosure, which is not shown in FIG. 8, so that the components of the chip sensor 204, the receptacle 210 and the chute 824 can be clearly seen. The electromagnetic shielding enclosure prevents external electromagnetic signals (such as those generated when a user operates his mobile phone while using the self-service kiosk 100) from interfering with the chip sensor 204 operation. Accordingly, the detection stage 800 provides a mechanism that is able to automate the detection of chips in a reliable manner.

Returning to FIG. 4, one implementation of the self-service kiosk 100 omits a return tray for received chips that are rejected. The return tray may be omitted since detection stage 400 does not have a passageway to guide the received chips from the chip slot 120 into the receptacle 410, whereby a shutter mechanism configured to close the chip slot 120 opens to allow removal of rejected chips directly from the receptacle 410. Such direct removal is possible because there is no obstruction between the return tray and the chip slot 120.

Another implementation has the self-service kiosk 100 being equipped with a return tray for rejected chips, rather than allowing for their direct removal from the receptacle 410. This return tray is disposed downstream of the receptacle 410, to collect all chips from the receptacle 410 after the receptacle 410 is tilted to empty its content, the collected chips including those that may be authentic. Similarly, referring to the detection stage 200 of FIG. 2, after the received chips 202 are read by the chip sensor 204, they are removed from the receptacle 210 for storage or return. The rotation range of the actuator to which the receptacle 210 is coupled allows the tilting of the receptacle 210 for this release and to ready the receptacle 210 for the next batch of received chips 202. The removal of these read chips is described with reference to FIG. 10. For the sake of simplicity, while FIG. 10 references the detection stage 200 shown in FIG. 2 to describe the tilting of its receptacle 210 to empty its contents, this description is equally applicable to the detection stage 400 shown in FIG. 4 and the detection stage 800 shown in FIG. 8.

Figure 10:
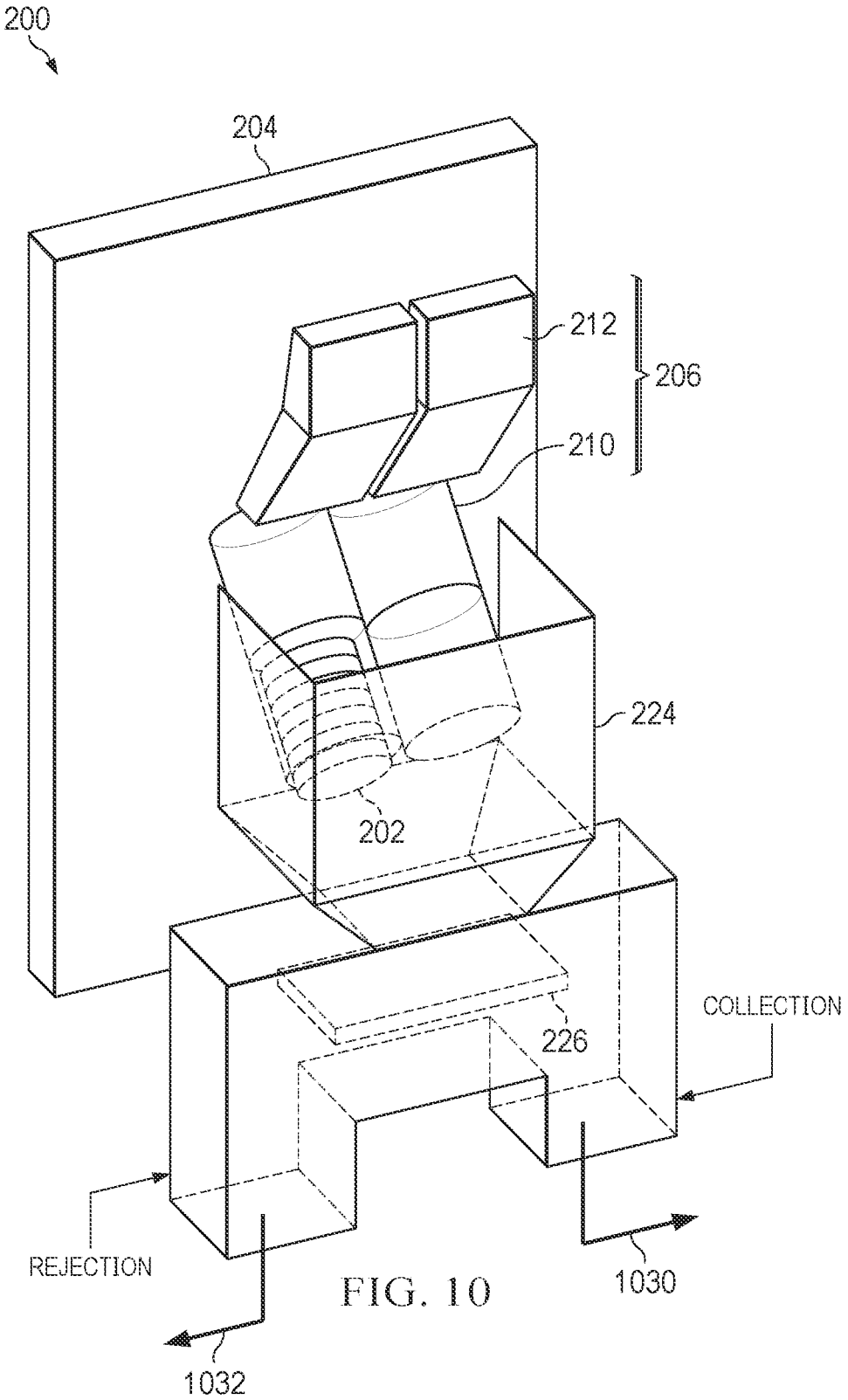
FIG. 10 is another perspective view of the detection stage of FIG. 2 when its receptacle is tilted to remove received chips.

FIG. 10 is a perspective view of the detection stage 200 of FIG. 2 when the receptacle 210 is tilted to remove the received chips 202. The chute 224 is for the received chips 202 dropped off from the receptacle 210, after they are counted by the chip sensor 204. The receptacle 210 is tilted to drop the received chips in the direction 1030 of either a collection bin 1250 (refer FIG. 12) or the direction 1032 of the return tray 114 (refer FIG. 1). The collection bin 1250 is for storing received chips 202 that are accepted, while the return tray 114 is for releasing the received chips 202 that are rejected.

The chute 224 has a divider 1026 which is used to divert the received chips 202 into the collection bin 1250 when the received chips 202 are determined to be accepted or divert the received chips 202 into the return tray 114 when the received chips 202 are determined to be rejected. Operation of this divider 226 is explained in more detail in FIGS. 11A and 11B, which reference the detection stage 800 of FIG. 8.

Figure 11B:
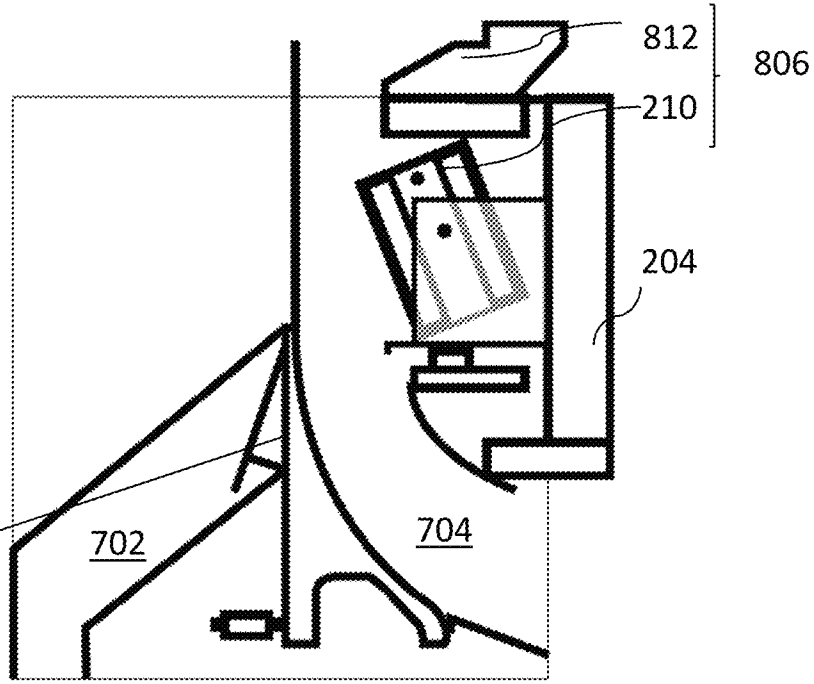
FIGS. 11A and 11B are side views of the detection stage of FIG. 8 to illustrate operation of its divider.
Figure 11A:
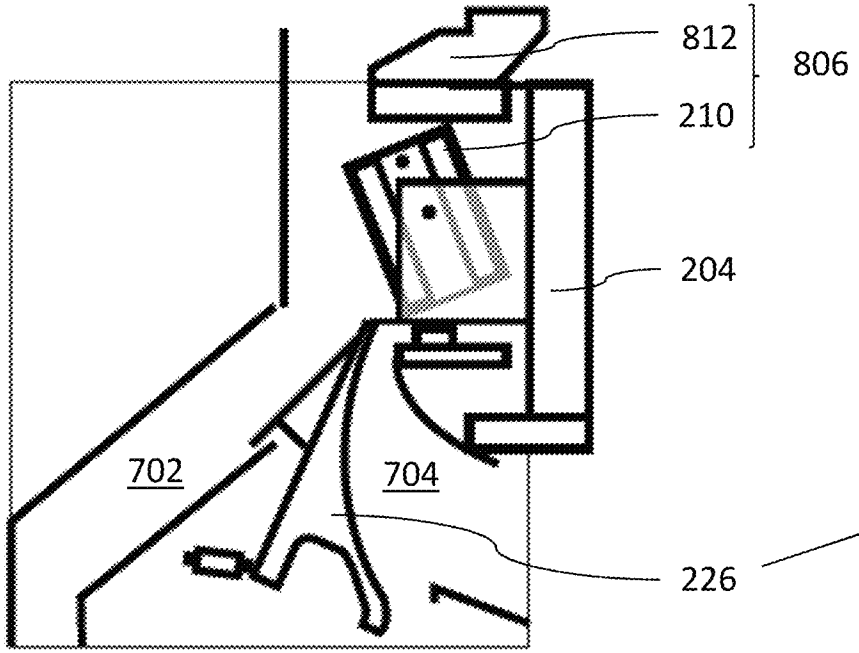

FIGS. 11A and 11B are side views of the detection stage 800 of FIG. 8. The divider 226 is a member that swivels between two positions. When the received chips 202 are determined to be accepted, the divider 226 swivels to block a corridor 704 that leads the received chips 202 to the return tray 114 (see FIG. 11A). When the received chips 202 are determined to be rejected, the divider 1026 swivels to block a corridor 702 that leads the received chips 202 to the collection bin 1250 (see FIG. 11B).

Figure 12:
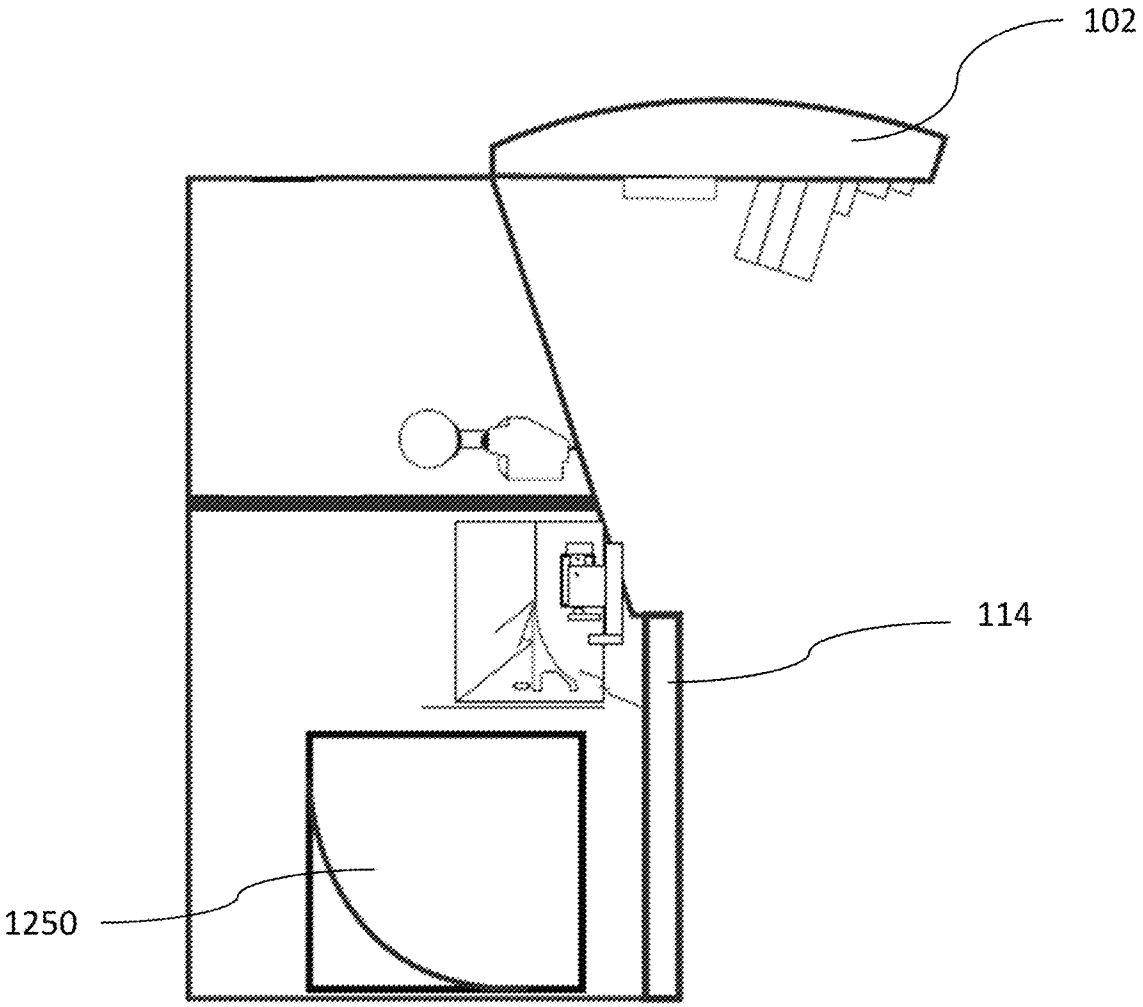
FIG. 12 shows a cross sectional view of the self-service kiosk of FIG. 1 with its top door open.

FIG. 12 shows a cross sectional view of the self-service kiosk 100, where the top door 102 is open. FIG. 12 shows the collection bin 1250 which is used to store the received chips and the return tray 114 from which a user collects rejected chips. The collection bin 1250 has a hole (not shown) through which the received chips fall to be stored. This hole is automatically closed by a cover when the collection bin 1250 is removed from the self-service kiosk 100. Upon removal, a mechanical catch provided on the collection bin 1250 is disengaged, which causes the cover to slide over the hole. When the collection bin 1250 is returned to the self-service kiosk 100, the mechanical catch engages, which causes the cover to slide to expose the hole.

Figure 13:
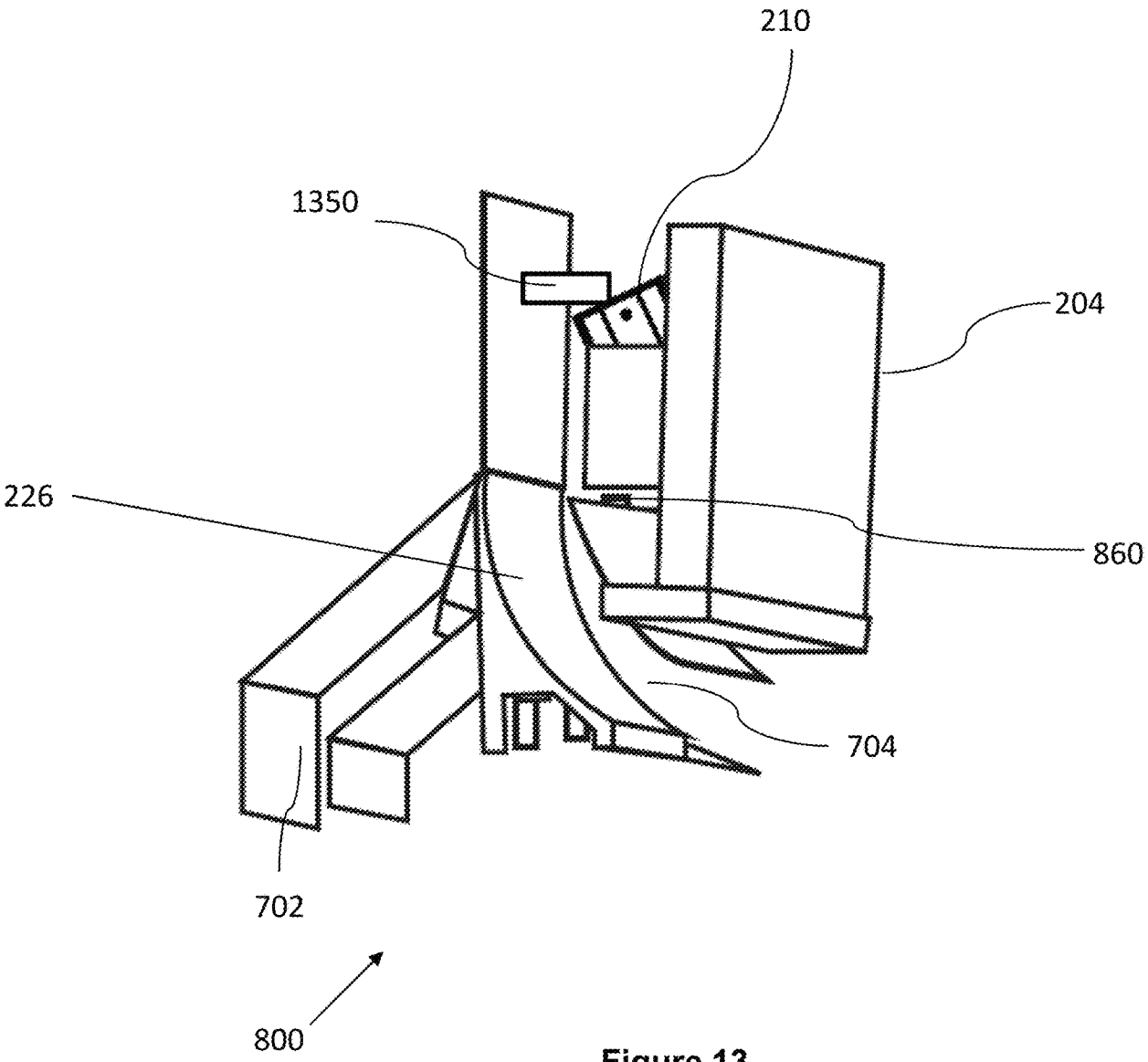
FIG. 13 shows a further perspective view of the detection stage of FIG. 8 showing its weight detector.

FIG. 13 shows a perspective view of the detection stage 800 of FIG. 8 to describe another component of the detection stage 800 (confer FIG. 8), namely the weight detector 860.

The weight detector 860 provides a safeguard against accepting received chips that contain unauthentic chips (i.e. those not recognised by the self-service kiosk 100), whether due to genuine error or attempted fraud. This safeguard is in addition to that provided by the authentication function of the chip sensor 204. This further safeguard is especially applicable when the chips that the self-service kiosk 100 is designed to process are within allocated weight tolerances.

The weight detector 860 is coupled to the receptacle 210 such that it can determine a weight of the received chips in the receptacle 210. This coupling may be achieved by having a sensing arm be in contact with the receptacle 210, whereby displacement of the sensing arm provides an indication of the weight of the receptacle 210 content. Accordingly, the weight detector 860 need not necessarily tilt together with the receptacle 210. The reading of the weight detector 860 and the counted number of the authenticated chips is used in tandem as follows. Although not shown, the weight detector 860 may be coupled to the receptacle 210 of the detection stage 200 of FIG. 2 and the receptacle 410 of the detection stage 400 of FIG. 4 in the same manner.

The self-service kiosk 100 is configured to receive a signal from the weight detector 860 providing the weight of the received chips. The self-service kiosk 100 also receives a signal from the chip sensor 204 providing a number count of the received chips. The weight of the received chips is then measured against a weight derived from the number count of the received chips. The weight is derivable since the self-service kiosk 100 has a record of the weight of a single chip from being designed to process such equally weighted chips. If all received chips are authentic, then the weight measured by the weight detector 860 will tally with the weight derived from the number count of the received chips. However, if there are unrecognisable chips amongst the received chips, the chip sensor 204 will not detect them, so that the total number of counted chips will be less than the number of received chips. The weight derived from the counted number of chips will then be different (likely less) from the measured weight of all the received chips. In such a scenario, the self-service kiosk 100 will transmit an alert that the measured weight of the received chips differs from a weight derived from the number count of the received chips. Such an alert may cause the self-service kiosk 100 to reject all the received chips and have them returned via the return tray 114.

The record maintained in the self-service kiosk 100 of the weight of single chips may be obtained from a central database with which the self-service kiosk 100 is in communication. This allows for forward compatibility, i.e. to cater for having the self-service kiosk 100 accept a new range of chips or entirely change the type of chips that the self-service kiosk 100 can accept, thereby ensuring that the self-service kiosk 100 can still accurately derive the weight of such received chips from their number count. The weight of a single chip stored in this maintained record is thus obtained from data communicated to the self-service kiosk 100 from the central database. As such, the weight derived from the number count of the received chips is based on data communicated to the self-service kiosk 100 providing a weight of the received chips.

Each of the received chips need not necessarily have the same weight. For instance, the weight of a casino token may depend on its denomination, where a token with a higher denomination may weigh more than a token with a lower denomination, e.g. a $50 casino token may weigh 12 g, while a $20 chip may weigh 10 g. The electronic tag of both tokens could be programmed with their respective denominations, which is detectable by the chip sensor 204 when obtaining the number count of the received chips. The weight of the chip of each detected denomination is then retrieved from the self-service kiosk 100 record and summed to obtain the derived total weight. This derived weight is then compared with the measured weight of the received chips, as read by the weight detector 860. A discrepancy between the derived weight and the measured weight causes the self-service kiosk 100 to transmit an alert. For example, if the chip sensor 204 counts five $50 casino tokens which weigh 12 g each and three $20 casino tokens which weigh 10 g each, the derived weight is 90 g. If the measured weight is not 90 g, this would be an indication to the self-service kiosk 100 that there are unrecognisable or fraudulent chips amongst the received chips.

The self-service kiosk 100 may also maintain a record of chips which are detectable by the chip sensor 204, but only encashable by certain category of users. For the purposes of this disclosure, such chips are termed "premium tokens" and the category of users that can encash them are termed "premium players". The self-service kiosk 100 will only encash such chips if the user identifies themselves to the kiosk 100 as being a member of such category of users. Upon detection of such casino tokens by the chip sensor 204 being inserted by a user that does not belong to this category of users, the self-service kiosk 100 may reject processing all of the received chips and display an alert requesting for the user to approach a counter.

The impact from the received chips landing in the receptacle 210 may have a residual effect that could affect subsequent measurements taken by the weight detector 860. For instance, the weight detector 860 may erroneously have a non-zero reading after it is emptied of received chips. To ensure an accurate measurement of the next batch of received chips, the weight detector 860 is tared before a next reading of the measured weight of a batch of received chips.

As an alternative or an additional safeguard provided by the weight detector 860, the self-service kiosk 100 is provided with a counting detector 1350 that detects the number of chips that enter the receptacle 210. The counting detector 1350 output is a physical count of the number of chips that enters the receptacle 210, which is separate from an electronic count output by the chip sensor 204, since the electronic count depends on whether the received chip is embedded with an electronic tag that is recognised by the chip sensor 204. The counting detector 1350 may be a mechanical sensor, such as a deflector whose actuation indicates the number of chips that enter the receptacle 210; or an electronic sensor, such as an optical transmitter and receiver pair where interruption of signal output indicates the number of chips that enter the receptacle 210. The physical count of the received chips, obtained from the counting detector 1350 is then compared against the electronic count obtained from the chip sensor 204. The self-service kiosk 100 will transmit an alert if the physical count of the received chips differs from the electronic count of the received chips. Such an alert may cause the self-service kiosk 100 to reject all the received chips and have them returned via the return tray 114.

Together, the counting detector 1350 and the weight detector 860 provide the self-service kiosk 100 with a chip authentication or validation mechanism to ensure that the received chips are recognised by the self-service kiosk 100, so that only recognised chips are stored in the collection bin 1250 (refer FIG. 12). The self-service kiosk 100 may be provided with either the weight detector 860, the counting detector 1350 or both, whereby either of them or both is used to perform the chip authentication function. While FIG. 13 shows that the counting detector 1350 is located at the mouth of the receptacle 210, it will be appreciated that the counting detector 1350 may be located elsewhere, such as between the chip slot 120 and the passageway 712 (refer FIG. 8).

A height sensor is disposed at the receptacle 210 to determine whether the received chips reach a height limit within the receptacle 210, as a means to ensure that the number of received chips does not exceed a quota which the self-service kiosk 100 is configured to process in one pass. This height sensor is in communication with a shutter mechanism located adjacent to the chip slot 120, where the shutter mechanism is configured to close the chip slot 120 in response to the height sensor indicating the height limit being reached. The height sensor may be located near the opening of the receptacle 210 and may be an optical transmitter and receiver pair, whereby the height sensor determines that the height limit is reached when a chip is detected to be between the optical transmitter and the optical receiver.

Received chips are determined to be accepted when one or more of the following scenarios occur: a) receipt of user confirmation that the number count provided by the chip sensor 204 is correct and that the weight of the received chips (as measured by the weight detector 860) tallies with the weight derived from the number count of the received chips; b) receipt of user confirmation that the number count provided by the chip sensor 204 is correct and that the number count from the counting detector 1350 tallies with the number count received from the chip sensor 204; or c) receipt of user confirmation that the number count provided by the chip sensor 204 is correct, along with the weight of the received chips (as measured by the weight detector 860) tallying with the weight derived from the number count of the received chips and the number count from the counting detector 1350 tallying with the number count received from the chip sensor 204. Received chips are determined to be rejected when one or more of the following scenarios occur: the alert that the weight of the received chips differs from the weight derived from the number count of the received chips is transmitted, the alert that the number count from the counting detector 1350 differs from the number count received from the chip sensor 204 is transmitted; or lack of receipt of the user confirmation that the number count provided by the chip sensor is correct.

When the self-service kiosk 100 is used for casino tokens, the self-service kiosk 100 further includes a cash repository (not shown), wherein the chip counting repository is configured to receive user confirmation that the number count provided by the chip sensor 204 is correct; and dispense from the cash repository a monetary value calculated from the counted received chips. The dispensed money may be output through the cash dispenser 110 (refer FIG. 1).

Figure 14:
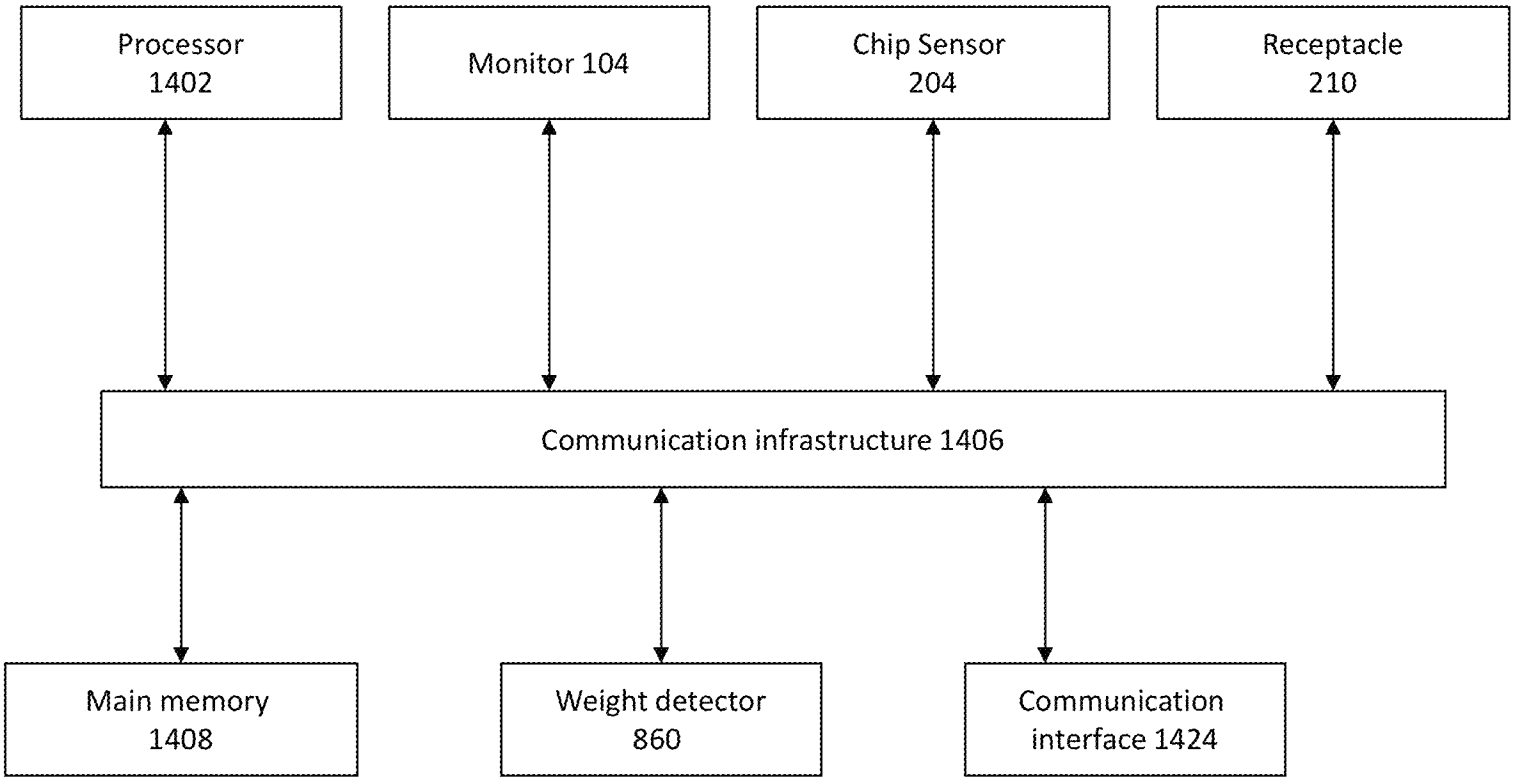
FIG. 14 shows functional blocks of computing architecture that is present in the self-service kiosk of FIG. 1.

FIG. 14 shows functional blocks of computing architecture that is present in the self-service kiosk 100. The self-service kiosk 100 has a processor 1402 and memory 1408 having computer program code that when executed cause the processor 1402 to control the various components of the self-service kiosk 100 to perform its chip processing functions. When performing these functions, the processor 1402 effects communication, over communication infrastructure 1406, with all components of the self-service kiosk 100. The communication infrastructure 1406 refers to data communication channels such as a bus, cross-bar or network. Further, while only selected components of the self-service kiosk 100 are shown in FIG. 14, such as the chip sensor 204, the receptacle 210, the monitor 104 and the weight detector 860, it will be appreciated that all other components are also coupled to the communication infrastructure 1406 to be controlled by the processor 1402.

Non-exhaustive examples of the processor 1402 capabilities, effected by the executed computer program code stored in the memory, are described below. When the self-service kiosk 100 performs chip counting and authentication, the processor 1402 sends a signal to the receptacle 210 to tilt the receptacle 210 to an orientation where received chips located therein are countable by the chip sensor 204. The processor 1402 also activates the chip sensor 204 to transmit a sensing beam to read the received chips. The reflected beam off the reflected chips, which contains data on whether each of the received chips contains an electronic tag and whether they are recognisable, is received by the chip sensor 204. The weight of the received chips is derived from the received data. The measured weight of the received chips is obtained from the weight detector 860. The processor 1402 compares the derived weight against the measured weight to and sends an alert when they differ.

According to one approach, authentication of the received chips, which seeks to determine whether the received chips detected by the chip sensor 204 belong to a specific party and calculation of the monetary value of the received chips, are performed as follows. Each chip that belongs to the specific party is embedded with an electronic tag with a unique identity. An internal or external database contains records of the unique identity of each electronic tag, along with its monetary value. When the chip sensor 204 reads the received chips, the chip sensor 204 obtains the identities of the electronic tags embedded in the received chips. The identities are passed on to the processor 1402, which interrogates the database to determine whether they are registered therein. If each received identity matches a corresponding registered identity in the database, the received chips are determined to be authenticated. Since each registered identity has an associated monetary value, the monetary value of the received chips can be calculated by the processor 1402 summing each of the associated monetary values. Cash amounting to the associated monetary value can then be dispensed from a cash repository via the cash dispenser 110. Alternatively, a designated bank account can be credited with the monetary value calculated from the counted received chips. To perform this crediting, the processor 1402 communicates with a financial institution to which the designated bank account belongs through a communication interface 1424. Another approach credits the monetary value calculated from the counted received chips to a membership account that is provided to the self-service kiosk 100, for example at step 1506 of FIG. 15, explained in further detail below. A balance in a deposit account that is linked to the membership account is updated with this credited monetary value.

FIGS. 15 to 18 show flowcharts (1500, 1600, 1700 and 1800) of a chip redemption process that is performed by the self-service kiosk 100 of FIG. 1, configured for use in a casino.

At step 1502, the monitor 104 of the self-service kiosk 100 will display images of chips that are acceptable. These images may be uploaded from a backend server to which the self-service kiosk 100 is in communication.

At step 1504, the monitor 104 prompts a user to select a display language (e.g. English, Chinese, Japanese, and Indonesian) in response to the user touching the monitor 104.

At step 1506, the monitor 104 prompts for the user to indicate whether they are a member of the casino. If the user indicates that they are not a member, step 1508 occurs, which is described in FIG. 17. If the user indicates that they are a member, step 1510 occurs. If the self-service kiosk 100 does not receive an input, it will return to step 1502.

At step 1510, the user is prompted to insert/swipe/tap their membership card, where the self-service kiosk 100 awaits for the membership card at step 1512. If the membership card can be read at step 1514, the self-service kiosk 100 then communicates the membership card details to the backend server to validate the membership status. If the self-service kiosk 100 is unable to read the membership card at step 1514, step 1516 occurs where the user is prompted to seek cashier counter assistance.

At step 1518, if the backend server is unable to validate the user, for reasons such as the membership status being inactive, having outstanding credit or being on a monitoring list, step 1520 occurs, where the user is prompted to go to the cashier counter for assistance. If the backend server does not return with any error message, step 1522 occurs where the user is prompted to enter their pin number. The pin number is communicated to the backend server at step 1524 for verification. If the pin number is incorrect, the user is given a few more attempts to enter the correct pin, failing which the membership card is locked. The step 1516 occurs where the user is prompted to seek cashier counter assistance. A successfully validated pin will lead to step 1526, which is elaborated in further detail with respect to FIG. 16.

Figure 15:
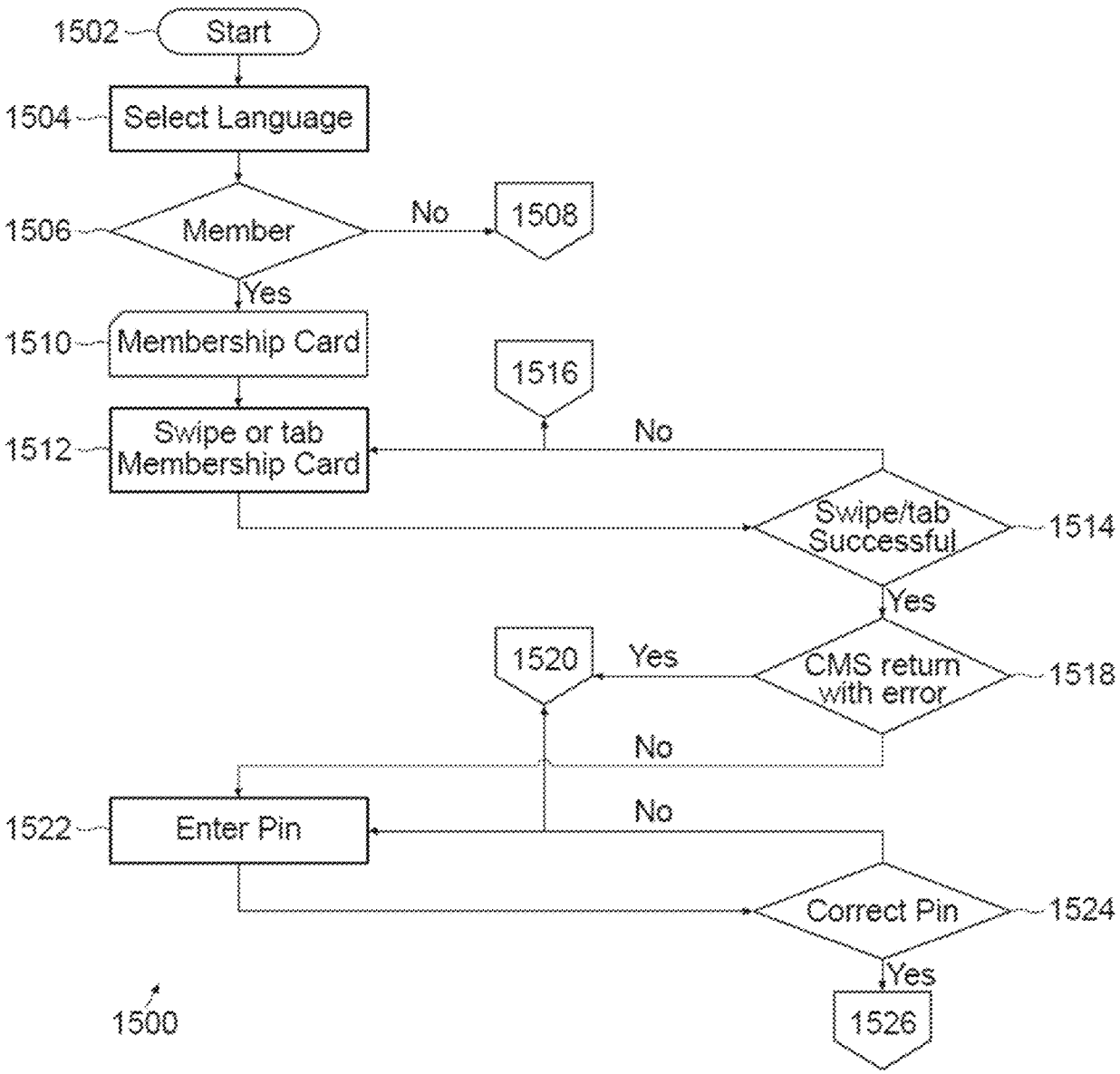
FIGS. 15 to 18 show flowcharts of a chip redemption process that is performed by the self-service kiosk of FIG. 1, configured for use in a casino.
Figure 16:
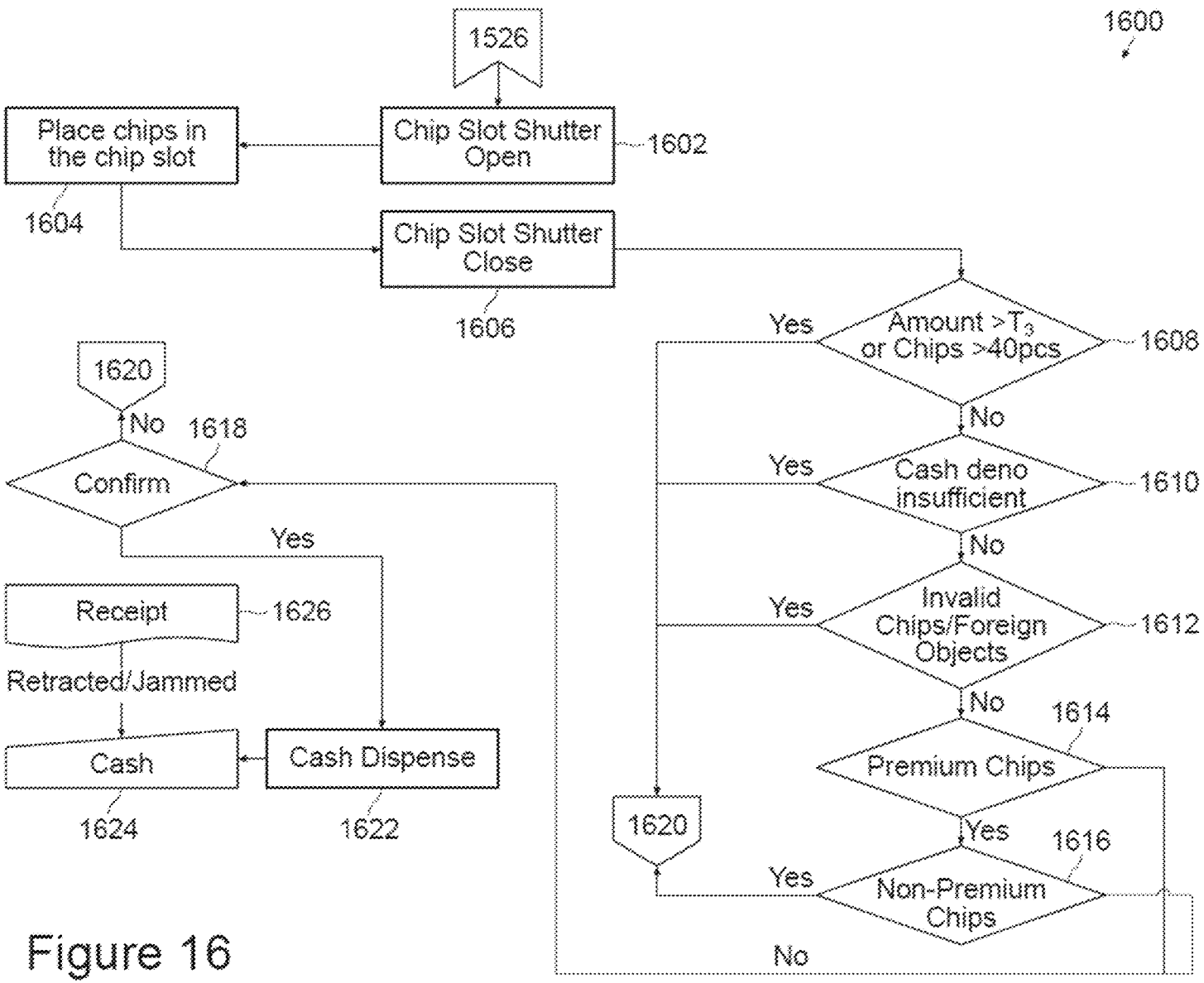

The flowchart 1600 of FIG. 16 begins at the same step 1526 from where the flowchart of FIG. 15 ends. At step 1602, a shutter preventing insertion of casino tokens into the self-service kiosk 100 opens and the user is prompted to insert casino tokens into the chip slot 120. The user then inserts their casino tokens at step 1604. The shutter will close at step 1606 under one of the following circumstances: after a period of inactivity; when a maximum number of casino tokens are inserted or when the user indicates that he has already inserted all of their tokens.

At step 1608, the self-service kiosk 100 will determine whether the detected cash value of the inserted casino tokens exceeds a maximum amount of cash that can be dispensed at each transaction. If the detected cash value is below the maximum amount that can be dispensed, step 1610 occurs where it is determined whether the self-service kiosk 100 has sufficient money in its repository to meet the detected cash value of the inserted casino tokens. If the self-service kiosk 100 has sufficient money, step 1612 occurs where it is detected whether there are invalid casino tokens, such as from a discrepancy between the derived weight of the received casino tokens and the measured weight of the casino tokens or a discrepancy between the number count of the chips from the counting detector 1350 and the number count of the received chips from the chip sensor 204, both discrepancies being described above with reference to FIG. 13. If the derived weight and the measured weight tally, step 1614 occurs where the self-service kiosk 100 detects whether there are any premium tokens present in the inserted casino tokens. If there are none, or if there are and the user is a premium player, step 1618 occurs where the monitor 104 displays a summary of the detected casino tokens and their total cash value.

On the other hand, the step 1618 will not occur if any one of the following occurs: the cash value of the inserted casino tokens detected at the step 1608 exceeds T3, a maximum amount of cash that can be dispensed at each transaction; the self-service kiosk 100 has insufficient money at the step 1610 to meet the detected cash value of the inserted casino tokens; the detection of invalid casino tokens at the step 1612; and the presence of premium tokens in the inserted casino tokens at the step 1616 where the user is not a premium player. Step 1620 will occur, which is described in further detail with respect to FIG. 18.

In the step 1618, the user is prompted to confirm whether the self-service kiosk 100 has correctly counted the inserted casino tokens. Upon user confirmation, step 1622 occurs where the cash is dispensed by the cash dispenser 110. The user collects the cash at step 1624 and a receipt of the redemption from the receipt printer 116 at step 1626. On the other hand, if the user does not confirm the counted sum at the step 1618, step 1620 occurs which is described in further detail with respect to FIG. 18.

Figure 17A:
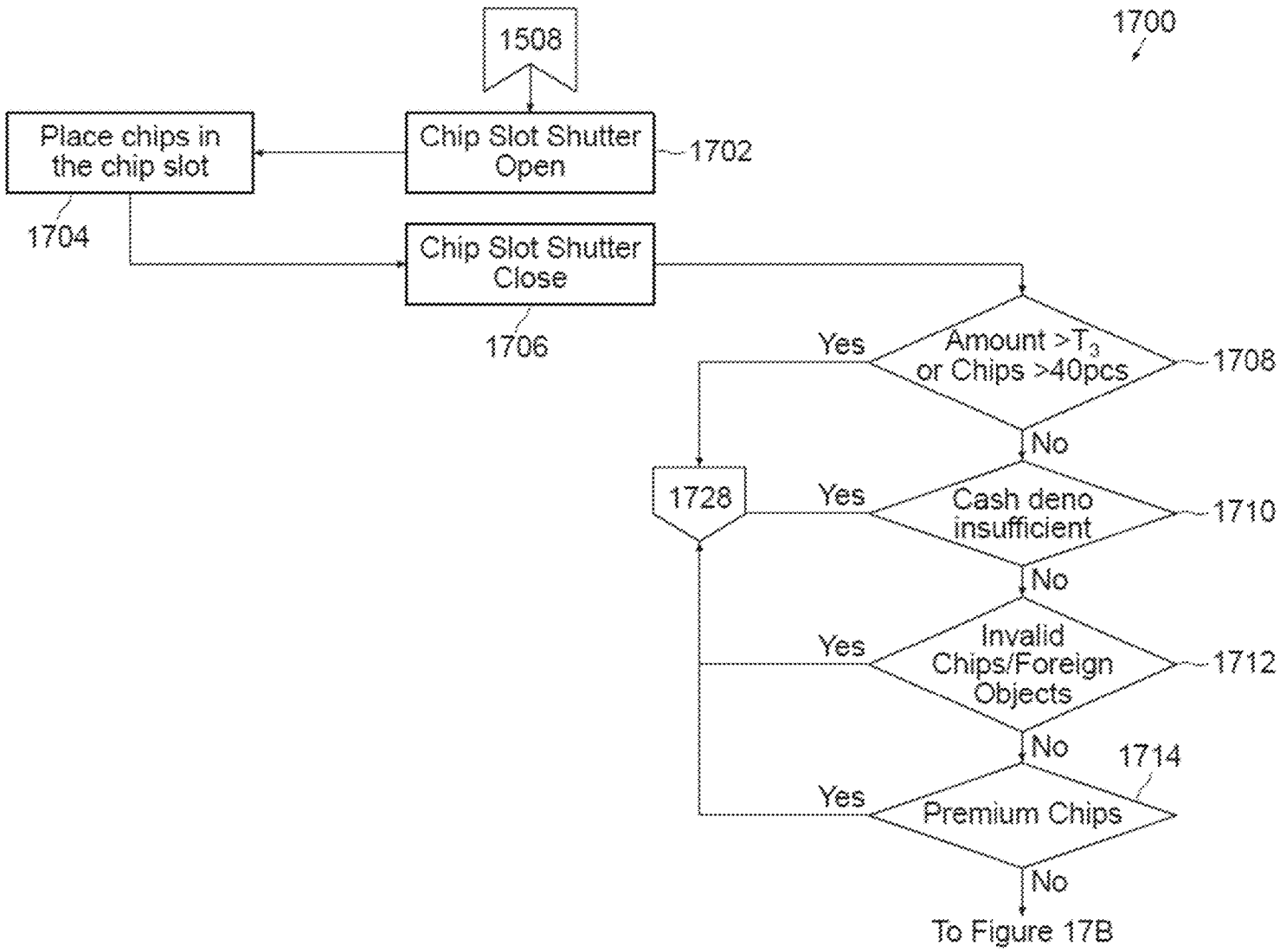
Figure 17B:
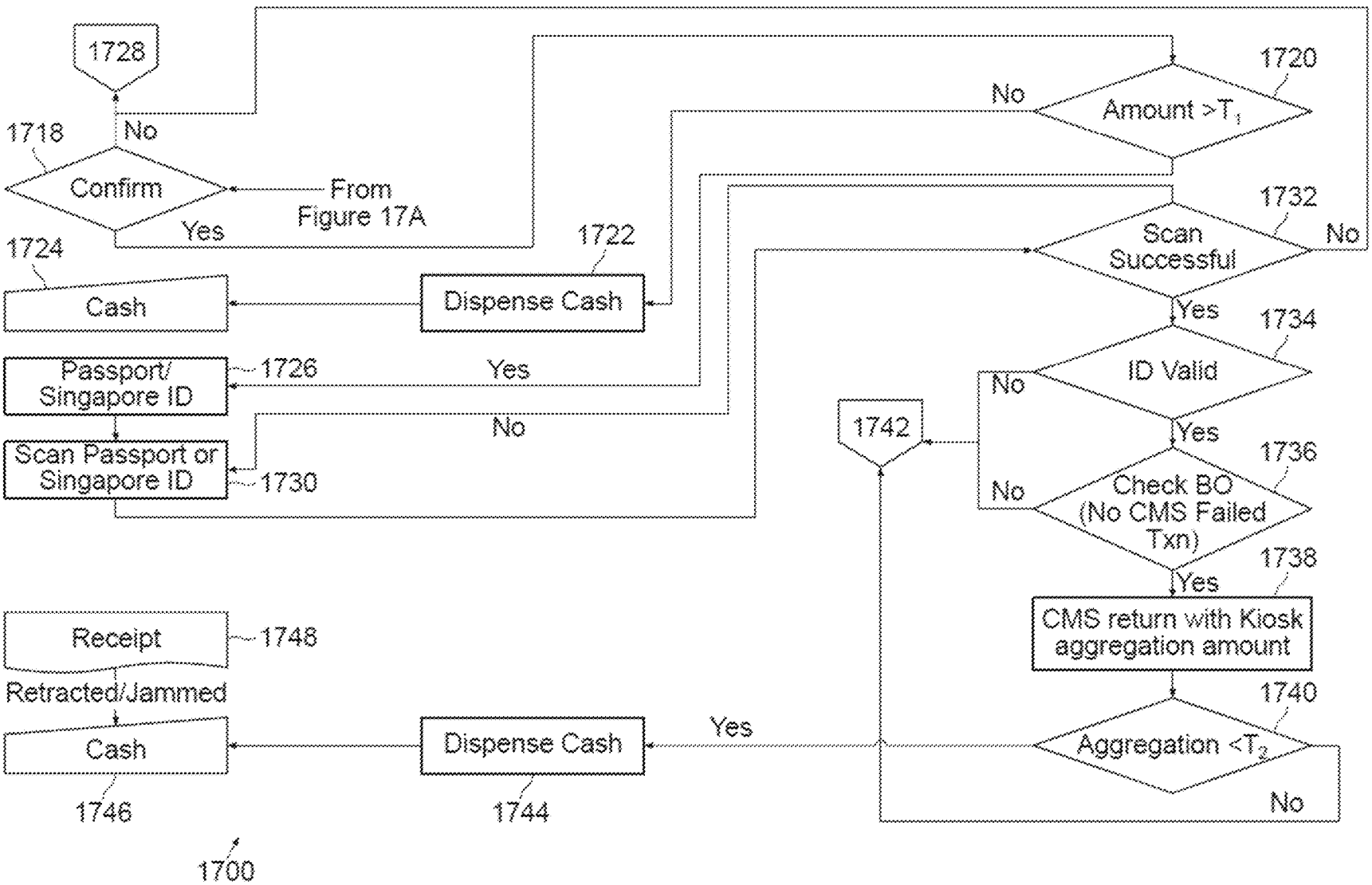

The flowchart 1700 spanning FIGS. 17A and 17B begins from the step 1508 of the flowchart 1500 of FIG. 15, where the user indicates to the self-service kiosk 100 that they are not a member of the casino. At step 1702, a shutter preventing insertion of casino tokens into the self-service kiosk 100 opens and the user is prompted to insert casino tokens into the chip slot 120. The user then inserts their casino tokens at step 1704. The shutter will close at step 1706 under one of the following circumstances: after a period of inactivity; when a maximum number of casino tokens are inserted or when the user indicates that he has already inserted all of their tokens.

At step 1708, the self-service kiosk 100 will determine whether the detected cash value of the inserted casino tokens exceeds a maximum amount of cash that can be dispensed at each transaction. If the detected cash value is below the maximum amount that can be dispensed, step 1710 occurs where it is determined whether the self-service kiosk 100 has sufficient money in its repository to meet the detected cash value of the inserted casino tokens. If the self-service kiosk 100 has sufficient money, step 1712 occurs where it is detected whether there are invalid casino tokens, such as from a discrepancy between the derived weight of the received casino tokens and the measured weight of the casino tokens, as described above with reference to FIG. 13. If the derived weight and the measured weight tally, step 1714 occurs where the self-service kiosk 100 detects whether there are any premium tokens present in the inserted casino tokens. If there are none, or if there are and the user is a premium player, step 1718 occurs where the monitor 104 displays a summary of the detected casino tokens and their total cash value.

On the other hand, the step 1718 will not occur if any one of the following occurs: the cash value of the inserted casino tokens detected at the step 1708 exceeds a maximum amount of cash that can be dispensed at each transaction; the self-service kiosk 100 has insufficient money at the step 1710 to meet the detected cash value of the inserted casino tokens; the detection of invalid casino tokens at the step 1712; and the presence of premium tokens in the inserted casino tokens at the step 1716 where the user is not a premium player. Step 1728 will occur, which is described in further detail with respect to FIG. 18.

In the step 1718, the user is prompted to confirm whether the self-service kiosk 100 has correctly counted the inserted casino tokens. Upon user confirmation, the self-service kiosk 100 determines at step 1720 whether the total amount is more than a value T1 (e.g. $2000), a threshold level above which the user is required to identify themselves to the self-service kiosk 100. If the total amount is less than T1, the cash is dispensed by the cash dispenser 110 at step 1722. The user collects the cash at step 1724. If the user does not confirm the counted sum at the step 1718, step 1728 occurs which is described in further detail with respect to FIG. 18.

If the total amount at the step 1720 is more than T1, step 1726 occurs where the user is prompted to identify themselves to the self-service kiosk 100 using some form of identification (e.g. an identity card or a passport). The user scans their identity at step 1730, where the self-service kiosk 100 determines at step 1732 whether the identity is scanned successfully. An unsuccessful scanning of the user identity leads to the step 1728. On the other hand, a successful scanning of the user identity at the step 1732 has the self-service kiosk 100 communicate at step 1734 the user details to the backend server to perform a validity check. If the identity is valid, step 1736 occurs where the self-service kiosk 100 checks with the backend server whether the user identity matches records of identities having failed transactions. Should the backend server unable to validate the user details at the step 1734 or should the user identity match records of identities having failed transactions, step 1742 occurs, which is described in further detail with respect to FIG. 18.

Step 1738 occurs when the user identity does not match records of identities having failed transactions. The self-service kiosk 100 obtains an aggregation amount of transactions made by the identified user (i.e. a summation of cash dispensed by the self-service kiosk 100 to the identified user from previous usage) in a gaming day and the counted amount of the inserted casino tokens at the step 1718. If the aggregation amount is ≥T2, a threshold level where regulations stipulate that casino tokens cannot be encashed through an automated kiosk (for example, because such users need to be physically verified or a manual record needs to made for encashment of such a sum of money), the step 1742 occurs where the transaction is rejected and the user is prompted to seek counter assistance. On the other hand, if the aggregation amount is less than T2, cash equating to the counted sum of the inserted casino tokens at the step 1718 occurs at step 1744 where the cash is dispensed by the cash dispenser 110. The user collects the cash at step 1746 and a receipt of the redemption from the receipt printer 116 at step 1748.

Figure 18:
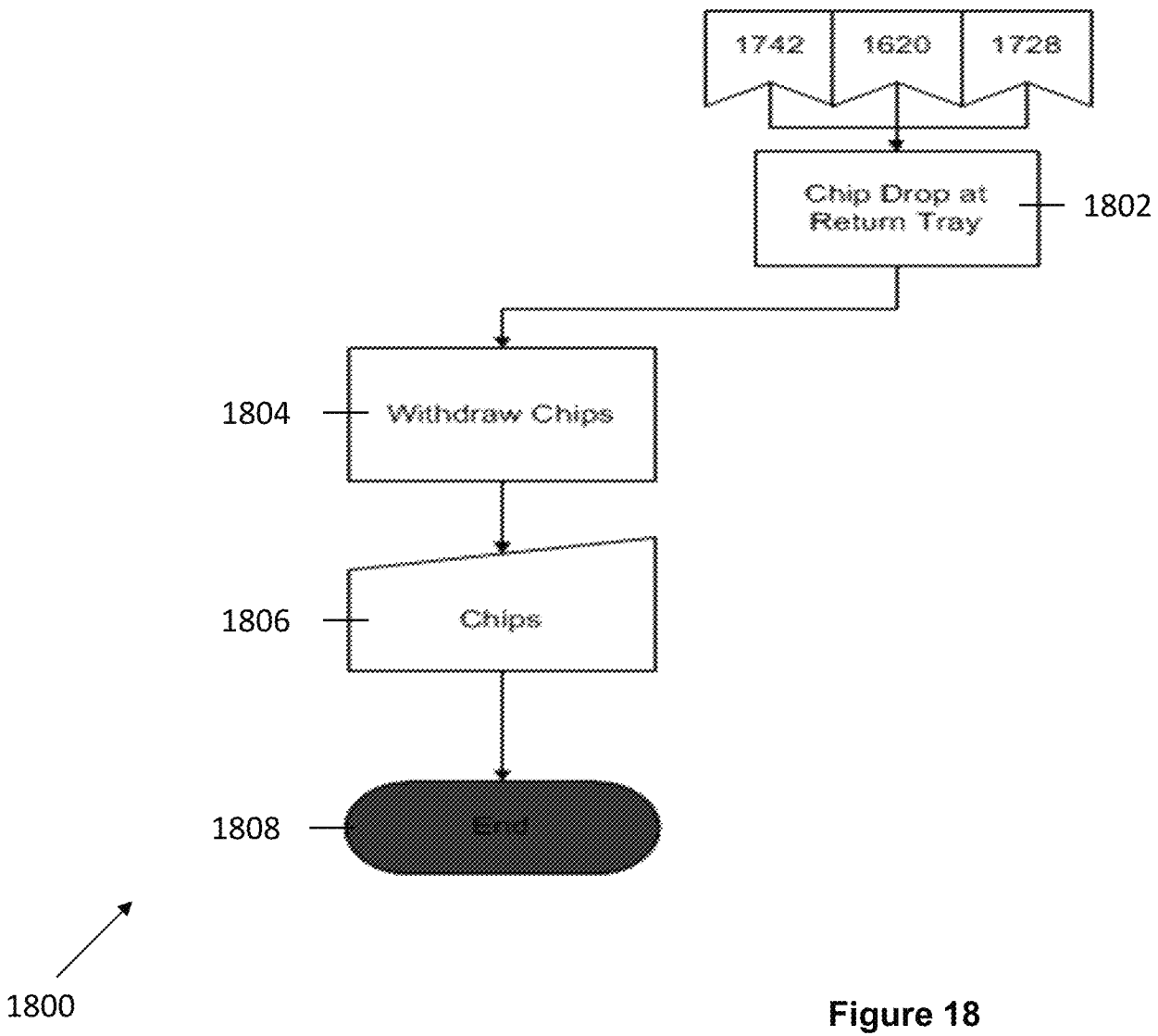

The flowchart 1800 of FIG. 18 begins from the step 1742 of the flowchart 1700 of FIG. 17, the step 1620 of the flowchart 1600 of FIG. 16 or the step 1728 of the flowchart 1700 of FIG. 17.

At step 1802, the self-service kiosk 100 sends the inserted casino tokens to the return tray 114. The user is prompted at step 1804 to remove the returned casino tokens. In one or more of the scenarios where casino token validation fails; there is insufficient money in the self-service kiosk 100; threshold exceed; member validation failure; premium chips being present when the user is not a premium player; discrepancy between the measured weight of the casino tokens and derived weight of the casino tokens; discrepancy between the number count of the chips from the counting detector 1350 and the number count of the received chips from the chip sensor 204; the user is prompted to seek cashier assistance to encash the returned casino tokens. The self-service kiosk 100 detects for the removal of the casino tokens from the return tray 114 at step 1806 and the flowchart 1800 ends at step 1808.

The above disclosure thus describes a self-service kiosk that can automatically identify inserted chips and authenticate them. The kiosk finds use in a casino, where the inserted chips are casino tokens have monetary value and the kiosk can tabulate the total monetary value of the inserted casino tokens, request confirmation of the tabulated amount from a user and then dispense the tabulated amount. The self-service kiosk is also able to count identically shaped chips having embedded electronic tags.

In the application, unless specified otherwise, the terms "comprising", "comprise", and grammatical variants thereof, intended to represent "open" or "inclusive" language such that they include recited elements but also permit inclusion of additional, non-explicitly recited elements.

While this invention has been described with reference to exemplary embodiments, it will be understood by those skilled in the art that various changes can be made and equivalents may be substituted for elements thereof, without departing from the spirit and scope of the invention. In addition, modification may be made to adapt the teachings of the invention to particular situations and materials, without departing from the essential scope of the invention. Thus, the invention is not limited to the particular examples that are disclosed in this specification, but encompasses all embodiments falling within the scope of the appended claims.

The invention claimed is:

1. A chip processing self-service kiosk comprising:

a chip slot;

a chip sensor; and a mechanical arrangement disposed downstream of the chip slot, the mechanical arrangement configured to allow received chips from the chip slot to be stacked in an orientation where the received chips are countable by the chip sensor, wherein the mechanical arrangement comprises a receptacle for the received chips from the chip slot and an actuator coupled to the receptacle, the actuator configured to tilt the receptacle to the orientation where the received chips are countable by the chip sensor.

2. The chip processing self-service kiosk of claim 1, wherein the receptacle is, by default, tilted in the orientation where the received chips are countable by the chip sensor.

3. The chip processing self-service kiosk of claim 1, wherein the receptacle is configured to shake before the received chips therein are counted by the chip sensor.

4. The chip processing self-service kiosk of claim 1, wherein the mechanical arrangement further comprises:

a passageway disposed to guide the received chips from the chip slot into the receptacle.

5. The chip processing self-service kiosk of claim 1, further comprising:

an electromagnetic shielding enclosure within which the chip sensor and the receptacle are disposed.

6. The chip processing self-service kiosk of claim 1, further comprising:

a chip authentication mechanism to determine that the received chips are recognised by the self-service kiosk.

7. The chip processing self-service kiosk of claim 6, wherein the chip authentication mechanism comprises a weight detector, a counting detector, or both, wherein the weight detector is coupled to the receptacle, the weight detector configured to determine a measured weight of the received chips in the receptacle, wherein the chip processing self-service kiosk is configured to:

receive a signal from the weight detector providing the measured weight of the received chips;

receive a signal from the chip sensor providing a number count of the received chips; and transmit an alert if the measured weight of the received chips differs from a weight derived from the number count of the received chips; and wherein the counting detector is configured to determine a number count of the received chips, separate from the chip sensor, and wherein the chip processing self-service kiosk is configured to receive a signal from the chip sensor providing a number count of the received chips; and transmit an alert if the number count from the counting detector differs from the number count received from the chip sensor.

8. The chip processing self-service kiosk of claim 7, further comprising:

a collection bin for storing received chips that are accepted; and a return tray for releasing received chips that are rejected, wherein the chip processing self-service kiosk is configured to cause the actuator to tilt the receptacle to drop the received chips in the direction of either the collection bin or the return tray after the received chips are counted by the chip sensor.

9. The chip processing self-service kiosk of claim 8, further comprising:

a divider configured to divert the received chips into either the collection bin when the received chips are determined to be accepted or divert the received chips into the return tray when the received chips are determined to be rejected.

10. The chip processing self-service kiosk of claim 9, wherein the received chips are determined to be accepted upon receipt of user confirmation that the number count provided by the chip sensor is correct and one or both of: the measured weight of the received chips tallying with the weight derived from the number count of the received chips; the number count from the counting detector tallying with the number count received from the chip sensor, and wherein the received chips are determined to be rejected when the alert that the measured weight of the received chips differs from the weight derived from the number count of the received chips is transmitted; the alert that the number count from the counting detector differs from the number count received from the chip sensor is transmitted; or lack of receipt of the user confirmation that the number count provided by the chip sensor is correct.

11. The chip processing self-service kiosk of claim 6, wherein the chip authentication mechanism comprises a weight detector coupled to the receptacle, the weight detector configured to determine a measured weight of the received chips in the receptacle, wherein the chip processing self-service kiosk is configured to:

receive a signal from the weight detector providing the measured weight of the received chips;

receive a signal from the chip sensor providing a number count of the received chips; and transmit an alert if the measured weight of the received chips differs from a weight derived from the number count of the received chips.

12. The chip processing self-service kiosk of claim 11, wherein the weight detector is tared before determining the measured weight.

13. The chip processing self-service kiosk of claim 11, wherein the weight derived from the number count of the received chips is based on data communicated to the chip processing self-service kiosk providing a weight of the received chips.

14. The chip processing self-service kiosk of claim 6, wherein the chip authentication mechanism comprises a counting detector configured to determine a number count of the received chips and wherein the chip processing self-service kiosk is configured to:

receive a signal from the chip sensor providing a number count of the received chips; and transmit an alert if the number count from the counting detector differs from the number count received from the chip sensor.

15. The chip processing self-service kiosk of claim 1, further comprising:

a height sensor disposed at the receptacle to determine whether the received chips reach a height limit within the receptacle.

16. The chip processing self-service kiosk of claim 15, further comprising:

a shutter mechanism configured to close the chip slot in response to the height sensor indicating the height limit being reached.

17. The chip processing self-service kiosk of claim 16, wherein the shutter mechanism closes the chip slot in response to chip processing self-service kiosk failure.

18. The chip processing self-service kiosk of claim 1, wherein the chip processing self-service kiosk further comprises a cash repository and wherein the chip processing self-service kiosk is configured to:

receive user confirmation that the number count provided by the chip sensor is correct; and dispense from the cash repository a monetary value calculated from the counted received chips.

19. The chip processing self-service kiosk of claim 18, wherein the chip processing self-service kiosk is configured to effect the crediting of a membership account with the monetary value calculated from the counted received chips.

20. The chip processing self-service kiosk of claim 1, wherein the chip processing self-service kiosk is further configured to determine whether the counted received chips are registered in a database.

21. The chip processing self-service kiosk of claim 1, wherein the chip sensor is a unidirectional RFID antenna.

* * * * *